US011656582B2

(12) United States Patent
Watanabe et al.

(10) Patent No.: US 11,656,582 B2
(45) Date of Patent: May 23, 2023

(54) RADIO WAVE WATCH

(71) Applicant: CITIZEN WATCH CO., LTD., Nishitokyo (JP)

(72) Inventors: Yoshiyasu Watanabe, Koganei (JP); Ken Kitamura, Nishitokyo (JP); Shuji Naka, Fuchu (JP); Akira Kato, Tokorozawa (JP)

(73) Assignee: CITIZEN WATCH CO., LTD., Nishitokyo (JP)

( * ) Notice: Subject to any disclaimer, the term of this patent is extended or adjusted under 35 U.S.C. 154(b) by 534 days.

(21) Appl. No.: 16/753,437

(22) PCT Filed: Sep. 18, 2018

(86) PCT No.: PCT/JP2018/034461
§ 371 (c)(1),
(2) Date: Apr. 3, 2020

(87) PCT Pub. No.: WO2019/069673
PCT Pub. Date: Apr. 11, 2019

(65) Prior Publication Data

US 2020/0319605 A1 Oct. 8, 2020

(30) Foreign Application Priority Data

Oct. 4, 2017 (JP) ..... JP2017-194336

(51) Int. Cl.
*G04R 60/12* (2013.01)
*G04C 10/02* (2006.01)
(Continued)

(52) U.S. Cl.
CPC ..... *G04R 60/12* (2013.01); *G04C 10/02* (2013.01); *G04G 17/04* (2013.01); *G04R 20/02* (2013.01)

(58) Field of Classification Search
CPC ..... H01Q 1/273; H01Q 9/42; H01Q 5/378; G04G 17/04; G04C 10/02; G04C 17/0066; G04R 60/12; G04R 20/02
See application file for complete search history.

(56) References Cited

U.S. PATENT DOCUMENTS 9,869,975 B2 * 1/2018 Fujisawa ..... G04R 60/12
11,119,450 B2 * 9/2021 Mitani ..... G04R 60/12
(Continued)

FOREIGN PATENT DOCUMENTS

JP 2003-318650 A 11/2003
JP 2012-075090 A 4/2012
(Continued)

OTHER PUBLICATIONS

Communication dated Feb. 22, 2022 from the Japanese Patent Office in Japanese Application No. 2019-546611.
(Continued)

*Primary Examiner* — Edwin A. Leon
(74) *Attorney, Agent, or Firm* — Sughrue Mion, PLLC

(57) ABSTRACT

A radio wave watch includes: an exterior case; a dial plate disposed within the exterior case; a substrate disposed on a rear side of the dial plate within the exterior case; a first ground layer disposed on the substrate; an antenna that has a planar emitting electrode disposed between a center of the exterior case and an inner wall surface of the exterior case and opposed to the first ground layer, a planar short-circuit part electrically connecting an end part of the emitting electrode to the first ground layer, and a connecting part connecting the emitting electrode to a receiving circuit of the substrate; and a second ground layer disposed on an opposite side to the emission electrode side across the short-circuit part on the substrate and having a width equal to or greater than a width of the short-circuit part.

12 Claims, 34 Drawing Sheets

(51) Int. Cl.
*G04G 17/04* (2006.01)
*G04R 20/02* (2013.01)

(56) References Cited

U.S. PATENT DOCUMENTS

| | | | | |
|---|---|---|---|---|
| 11,226,594 | B2 * | 1/2022 | Yamamoto | G04C 10/02 |
| 11,435,701 | B2 * | 9/2022 | Nakajima | G04C 10/02 |
| 2003/0193439 | A1 | 10/2003 | Park | |
| 2016/0103428 | A1 | 4/2016 | Fujisawa | |
| 2017/0040681 | A1 | 2/2017 | Fujisawa | |
| 2018/0275617 | A1 * | 9/2018 | Hashizume | G04G 17/06 |

FOREIGN PATENT DOCUMENTS

| | | | |
|---|---|---|---|
| JP | 2016-080356 | A | 5/2016 |
| JP | 2017-37057 | A | 2/2017 |

OTHER PUBLICATIONS

International Search Report for PCT/JP2018/034461 dated Dec. 18, 2018 (PCT/ISA/210).
Communication dated Jan. 25, 2021, from the China National Intellectual Property Administration in application No. 201880064349.8.

* cited by examiner

RADIO WAVE WATCH

CROSS REFERENCE TO RELATED APPLICATIONS

This application is a National Stage of International Application No. PCT/JP2018/034461 filed Sep. 18, 2018, claiming priority based on Japanese Patent Application No. 2017-194336 filed Oct. 4, 2017.

FIELD

The present invention relates to a radio wave watch.

BACKGROUND

Conventional watches have an antenna. Patent Literature 1 discloses the technology of a watch device that has a housing configured with a metal concave container and where, in addition to a watch operating part, an inverted F antenna for receiving a radio wave from a GPS satellite is disposed in the concave part of the housing.

CITATION LIST

Patent Literature

Patent Literature 1: Japanese Patent Application Laid-Open. No. 2012-75090

SUMMARY

Technical Problem

There is room for improving the reception sensitivity of an antenna.

An object of the present invention is to provide a radio wave watch that can improve the reception sensitivity of an antenna.

Solution to Problem

A radio wave watch according to the present invention includes an exterior case; a dial plate disposed within the exterior case; a substrate disposed on a rear side of the dial plate within the exterior case; a first ground layer disposed on the substrate; an antenna that has a planar emitting electrode disposed between a center of the exterior case and an inner wall surface of the exterior case and opposed to the first ground layer, a planar short-circuit part electrically connecting an end part of the emitting electrode to the first ground layer, and a connecting part connecting the emitting electrode to a receiving circuit of the substrate; and a second ground layer disposed on an opposite side to the emitting electrode side across the short-circuit part on the substrate and having a width equal to or greater than a width of the short-circuit part.

Advantageous Effects of Invention

A radio wave watch according to the present invention has a second ground layer disposed on an opposite side to an emitting electrode side across a short-circuit part on a substrate and having a width equal to or greater than a width of the short-circuit part. The second ground layer improves the symmetricity of an antenna and an image antenna and improves the reception sensitivity of the antenna. The radio wave watch according to the present invention thus exhibits its effect of enabling the reception sensitivity of the antenna and improve the reception sensitivity.

DESCRIPTION OF EMBODIMENTS

A radio wave watch according to an embodiment of the present invention will now be described in detail with reference to the drawings. Note that this invention is not limited by this embodiment. Components in the following embodiment include components that those skilled in the art can conceive of easily or substantially the same as those.

Embodiment

Figure 1:
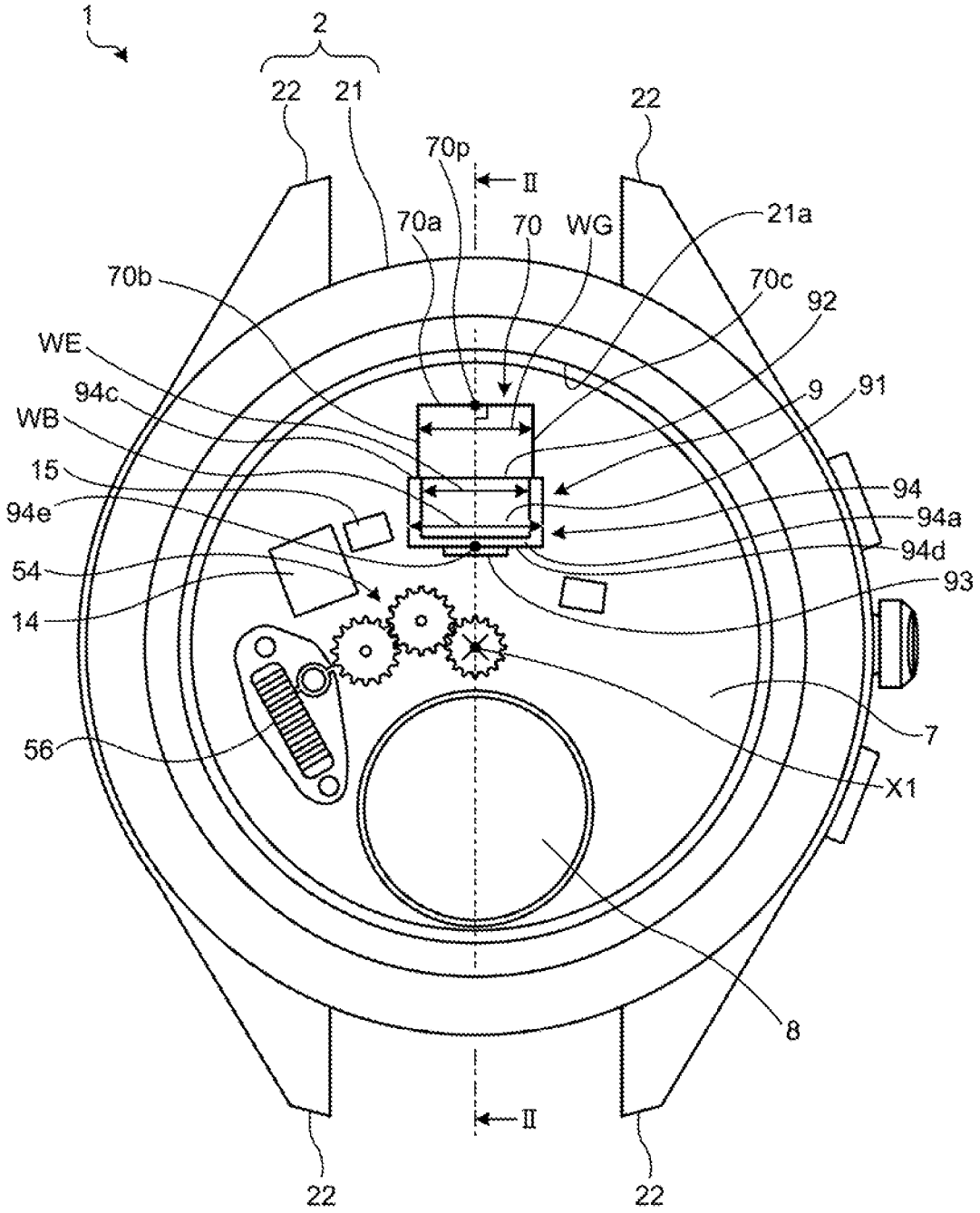
FIG. 1 is a plan view illustrating a radio wave watch according to an embodiment.
Figure 2:
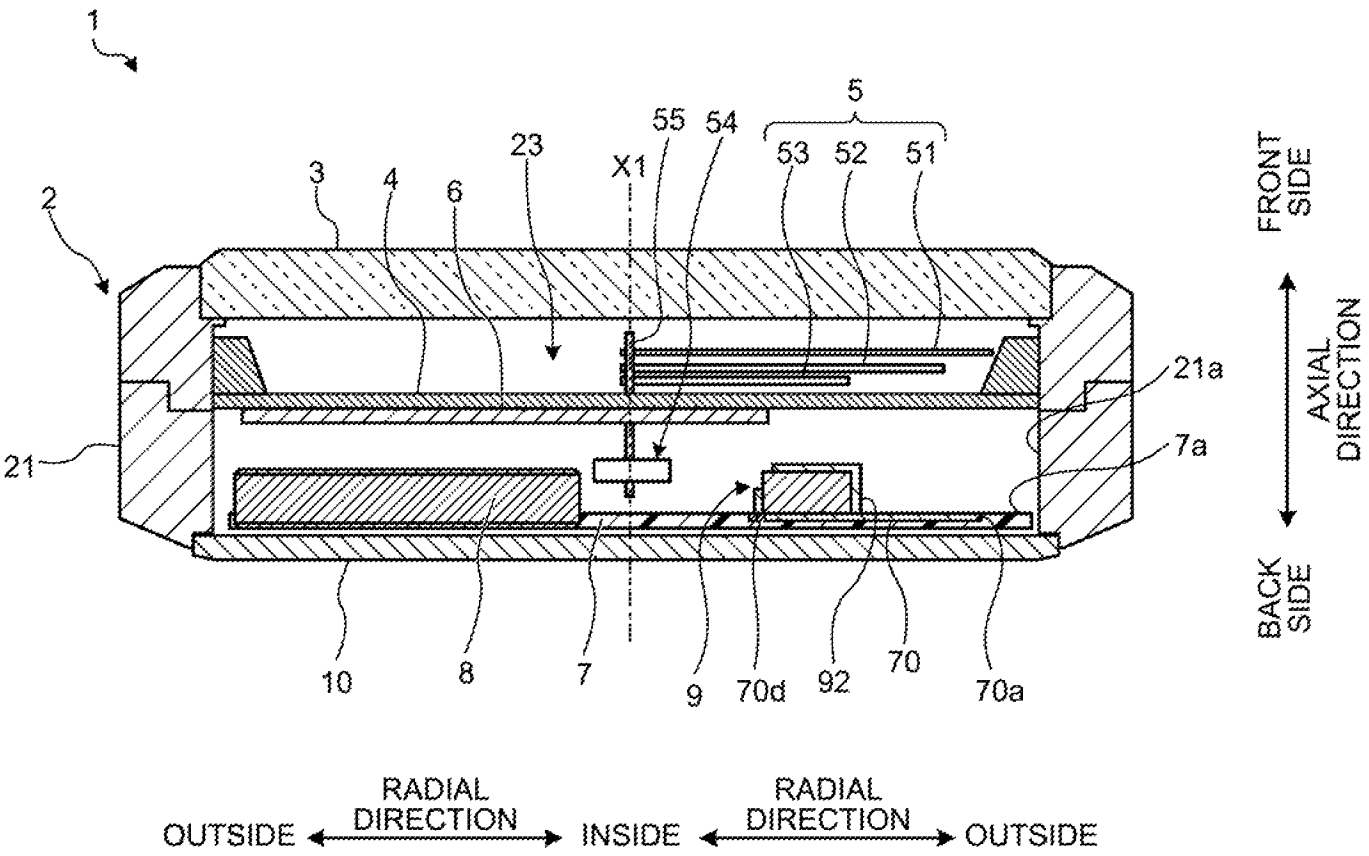
FIG. 2 is a sectional view of the radio wave watch according to the embodiment.
Figure 3:
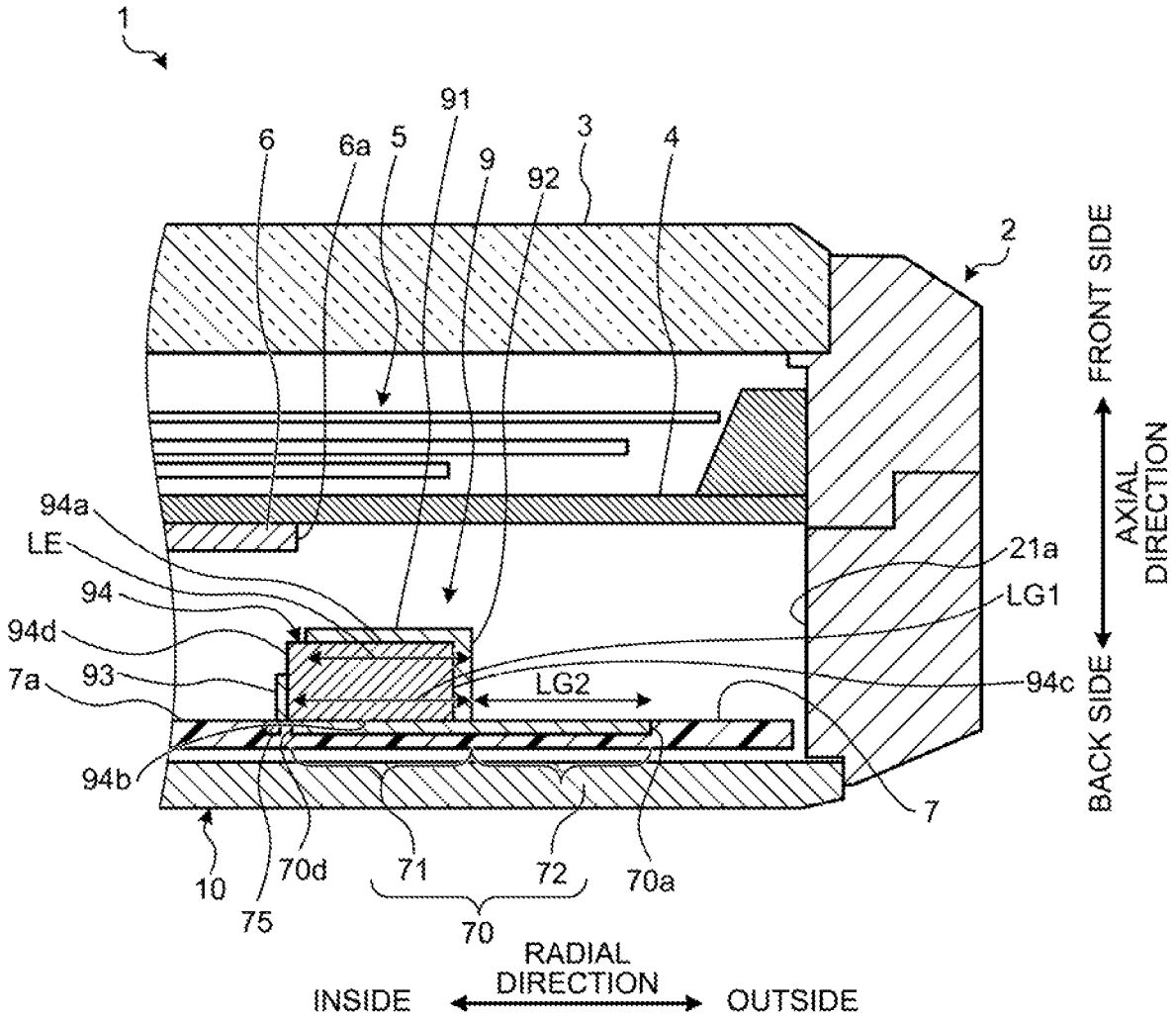
FIG. 3 is a sectional view of a main part of the radio wave watch according to the embodiment.
Figure 4:
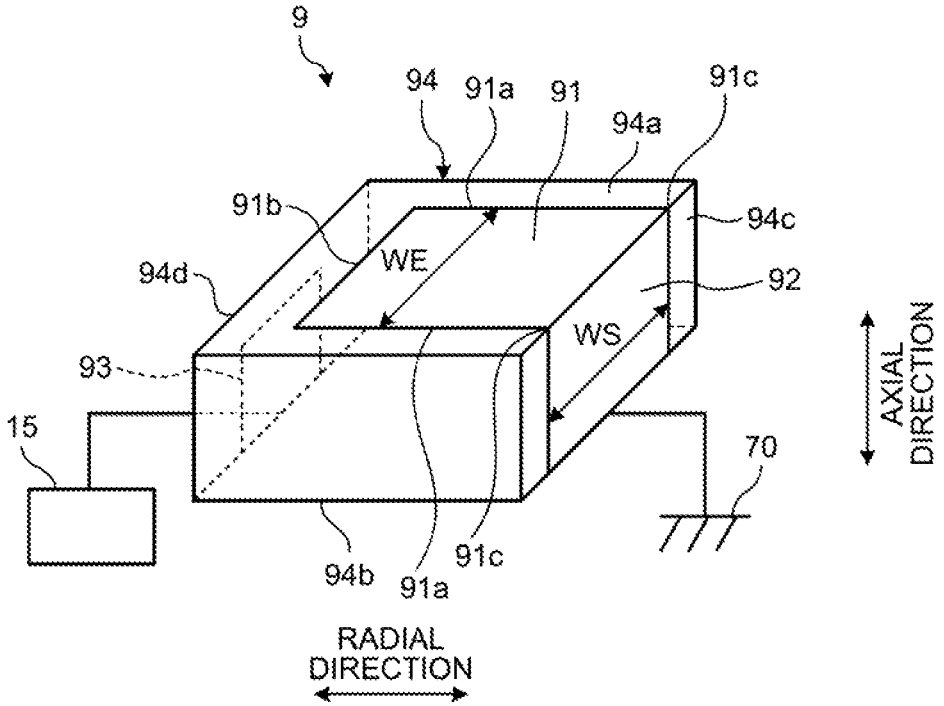
FIG. 4 is a perspective view of an antenna according to the embodiment.
Figure 5:
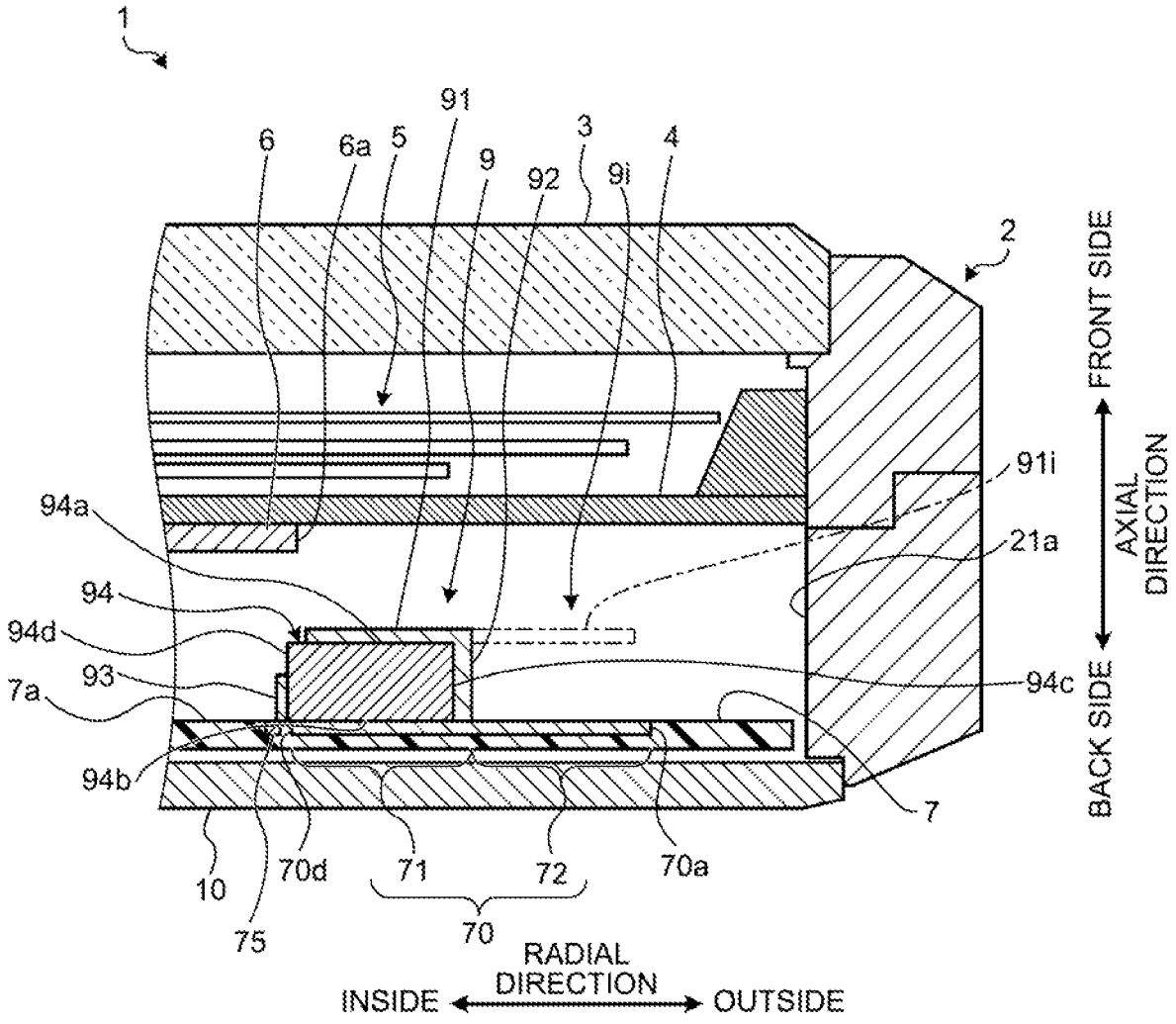
FIG. 5 is an illustrative view of an image antenna.

An embodiment will be described with reference to FIGS. 1 to 21. The present embodiment relates to a radio wave watch. FIG. 1 is a plan view illustrating a radio wave watch according to the embodiment; FIG. 2 is a sectional view of the radio wave watch according to the embodiment; FIG. 3 is a sectional view of a main part of the radio wave watch according to the embodiment; FIG. 4 is a perspective view of an antenna according to the embodiment; and FIG. 5 is an illustrative view of an image antenna. A section II-II in FIG. 1 is illustrated in FIG. 2.

As illustrated in FIGS. 1 and 2, a radio wave watch 1 of the embodiment has an exterior case 2, a windshield 3, a dial plate 4, a hand 5, a solar cell 6, a substrate 7, a battery 8, an antenna 9, and a rear cover 10. Note that the illustration of the windshield 3, the dial plate 4, the hand 5, and the solar cell 6 is omitted in FIG. 1. The radio wave watch 1 receives a radio wave from a satellite. The radio wave watch 1 has a function to correct its internal time based on information acquired from the radio wave. The radio wave watch 1 of the present embodiment receives a global positioning system (GPS) radio wave output from a GPS satellite. Note that the GPS radio wave is a radio wave including GPS time information and uses, for example, two types of a 1.5 GHz band (1575.42 MHz) and a 1.2 GHz band (1227.60 MHz).

The exterior case 2 is a member constituting the shell of the rad to wave watch 1. For example, the exterior case 2 is formed of a conductive material, such as titanium and titanium alloys. The exterior case 2 has an approximately cylindrical body part 21 and a lug 22. The body part 21 is a cylindrical constituent part where both ends in an axial direction are opened. The lug 22 is formed integrally with the body part 21 and projects from the circumferential surface of the body part 21 toward the outside in a radial direction. A belt is coupled to the lug 22.

In the present specification, the direction of a center axis line X1 of the body part 21 is referred to as an "axial direction". The axial direction corresponds to a vertical direction of the radio wave watch 1. Furthermore, a direction perpendicular to the center axis line X1 is referred to as a "radial direction", and a circumferential direction centered at the center axis line X1 is referred to as a "circumferential direction". In the radial direction, a side near the center axis line X1 is referred to as the "inside", and a side far from the center axis line X1 is referred to as the "outside".

The windshield 3 blocks an opening on the front side of the body part 21. The windshield 3 is formed of a transparent material, such as glass. The windshield 3 covers the dial plate 4 and the hand 5 on the front side. The rear cover 10 blocks an opening on the back side of the body part 21. The rear cover 10 is a plate-shaped member and, for example, is formed of metal. The rear cover 10 covers the substrate 7 on the hack side.

The exterior case 2 has an accommodating space 23, the sectional shape of which is generally circular. The accommodating space 23 is an inner space of the body part 21. The accommodating space 23 is a closed space surrounded by the body part 21, the windshield 3, and the rear cover 10. The accommodating space 23 accommodates the dial plate 4, the hand 5, the solar cell 6, the substrate 7, the battery 8, and the antenna 9.

The dial plate 4 is a disk-shaped member and fixed to the body part 21. The dial plate 4 is configured so that the dial plate 4 can pass light from the front side to the back side. For example, the dial plate 4 is formed of an optically transparent material. For example, the dial plate 4 may be formed of a non-conductive material, such as a synthetic resin.

The hand 5 has a second hand 51, a minute hand 52, and an hour hand 53. The hand 5 is disposed coaxially with the center axis line X1 of the exterior case 2. A rotation shaft 55 of the hand 5 is passed through a through hole of the dial plate 4. Each of the second hand 51, the minute hand 52, and the hour hand 53 is coupled to a drive source, such as a motor, through a wheel train 54. The wheel train 54 is disposed on the back side relative to the dial plate 4 and decelerates the rotation of a drive source 56 to convey it to the hand 5. The drive source 56 of the present embodiment is a step motor. The drive source 56 rotationally drives the hand 5 with power supplied from the battery 8.

The solar cell 6 is disposed on the back surface of the dial plate 4. The solar cell 6 is formed into a plane shape. The solar cell 6 converts received light into electric energy. The solar cell 6 is an aggregate of photovoltaic elements, and its front side is a light-receiving surface. The solar cell 6 generates electricity with light penetrating the dial plate 4. The solar cell 6 is electrically connected with the substrate 7. The power generated by the solar cell 6 may be supplied to devices of the radio wave watch 1, or may be charged into the battery 8.

The substrate 7 is disposed in the vicinity of the rear cover 10 in the accommodating space 23. The substrate 7 is fixed to a main plate, which is not shown, and the main plate is fixed to the body part 21. The substrate 7 is disposed separately on the back side from the dial plate 4 in the axial direction and is opposed to the dial plate 4. The substrate 7 is a component of a controller controlling the radio wave watch 1. The substrate 7 has a control circuit 14 and a receiving circuit 15. The control circuit 14 controls driving of the drive source 56 and corrects the internal time. The receiving circuit 15 is connected with the antenna 9. The receiving circuit 15 decodes a satellite signal received by the antenna 9 to generate a digital signal. The digital signal generated by the receiving circuit 15 is sent to the control circuit 14. The control circuit 14 corrects the internal time based on the signal acquired from the receiving circuit 15. The control circuit 14 can correct display time of the hand 5 based on the internal time. Furthermore, the control circuit 14 has, in a storage region, geographic data where location information is associated with time zones and, from a result of the satellite reception, can determine a time zone to which a current location belongs to reflect it on the watch.

A ground layer 70 is disposed on the substrate 7. For example, the ground layer 70 may be formed of a ground plate formed of a conductive material, a ground electrode film formed on the substrate 7, or other components. The position and shape of the ground layer 70 is determined depending on the position and shape of the antenna 9. As discussed below, the ground layer 70 of the present embodiment is disposed to be opposed to the antenna 9 and an image antenna 9*i* (see FIG. 5). The ground layer 70 of the present embodiment is formed on a front surface 7*a* of the substrate 7. The ground layer 70 is electrically connected with the exterior case 2. The electrical connection may be either direct-current connection or alternate-current connection. The ground layer 70 may be connected with the exterior case 2 via an inner layer of the substrate 7. Note that the ground layer 70 may be electrically connected with the rear cover 10 instead of the exterior case 2.

The shape of the ground layer 70 of the present embodiment is rectangular. The ground layer 70 has a first side 70*a*, a second side 70*b*, a third side 70*c*, and a fourth side 70*d*. The first side 70*a* is a side facing an inner wall surface 21*a* of the exterior case 2. The first side 70*a* and the fourth side 70*d* are opposed to each other in the radial direction. The second side 70*b* and the third side 70*c* are opposed to each other in the circumferential direction.

For example, the ground layer 70 is disposed so that a foot of a perpendicular line 70*p* drawn from the center axis line X1 to the first side 70*a* is the center of the first side 70*a* or a position in the vicinity of the center. In this case, each of the second side % and the third side 70*c* of the ground layer 70 is parallel to the perpendicular line. In the ground layer 70 of the present embodiment, the first side 70*a* is a short side, and the second side 70*b* and the third side 70*c* are long sides. The first side 70*a* is slightly shorter than the second side 70*b* and the third side 70*c*. Note that the length of the first side 70*a* may be equal to the length of the second side 70*b* and the third side 70*c*.

As illustrated in FIG. 1, a width WG of the ground layer 70 is greater than a width WE of an emitting electrode 91 described below. In the present embodiment, the width WG of the ground layer 70 is greater than the width WE of the emitting electrode 91 and is smaller than the width WB of a base part 94. Note that, in the present embodiment, a width WS of a short-circuit part 92 (see FIG. 4) is equal to the width WE of the emitting electrode 91. The width WG of the ground layer 70 is thus greater than the width WS of the short-circuit part 92. However, the width WG of the ground layer 70 may be equal to the width WS of the short-circuit part 92.

As illustrated in FIG. 3, the fourth side 70*d* of the ground layer 70 is located at an inside end part in the radial direction of the antenna 9. More specifically, the fourth side 70*d* is located inside in the radial direction relative to the inside end part in the radial direction of the emitting electrode 91. Thus, the short-circuit part 92 is disposed between the first side 70*a* and the fourth side 70*d* of the ground layer 70. The emitting electrode 91 is disposed between the short-circuit part 92 and the fourth side 70*d* on the ground layer 70. As illustrated in FIG. 1, the emitting electrode 91 is disposed between the second side 70*b* and the third side 70*c* of the ground layer 70. Note that the fourth side 70*d* may be located inside relative to the inside end part in the radial direction of the antenna 9.

The antenna 9 is disposed on the substrate 7. More specifically, the antenna 9 is disposed on the front surface 7*a* of the substrate 7. The antenna 9 is disposed between the center axis line X1 and the inner wall surface 21*a* of the exterior case 2. The antenna 9 has the emitting electrode 91, the short-circuit part 92, a connecting part 93, and the base part 94.

The base part 94 is formed, of a dielectric, into a cubic shape. For example, the base part 94 is formed of a non-conductive dielectric, such as a ceramic. The base part 94 is configured with a material having a high dielectric constant, such as zirconia or titanium oxide, and exhibits a wavelength-shortening effect. The shape of the base part 94 of the present embodiment is a rectangular parallelepiped. The base part 94 enables a substantial wavelength $\lambda'$ of a radio wave that the emitting electrode 91 receives to be smaller than a wavelength $\lambda$ corresponding to the frequency of the GPS radio wave.

As illustrated in FIG. 4, the base part 94 is disposed so that a front surface 94*a* faces the front side, or the front surface 94*a* is opposed to the windshield 3. The base part 94 is disposed so that a first side surface 94*c* is opposed to the inner wall surface 21*a* of the exterior case 2 and a second side surface 94*d* faces the center axis line X1 side. The first side surface 94*c* and the second side surface 94*d* are side surfaces located across the front surface 94*a* and face in mutually opposite directions. The base part 94 of the present embodiment is disposed so that the position of a foot of a perpendicular line 94*e* drawn from the center axis line X1 to the second side surface 94*d* is the center position in a width direction of the second side surface 94*d*. The shape of the antenna 9 is symmetric with reference to the perpendicular line drawn from the center axis line X1 to the foot of the perpendicular line 94*e*. Note that the first side surface 94*c* and the second side surface 94*d* of the present embodiment are side surfaces along the long side of the front surface 94*a*.

The ground layer 70 is formed so that the fourth side 70*d* (see FIG. 3) is parallel to the second side surface 94*d* of the base part 94 and the first side 70*a* is parallel to the first side surface 94*c* of the base part 94. The base part 94 is disposed in an inside region in the radial direction of the ground layer 70.

The emitting electrode 91 is disposed on the front surface 94*a* of the base part 94. The emitting electrode 91 is a planar constituent part formed of a material having conductivity, such as metal. The emitting electrode 91, as well as the short-circuit part 92 and the connecting part 93 described below may be configured with a conductive-material thin film formed on the dielectric, which is the base part 94, or may be configured with a plate-shaped member. Note that the antenna 9 illustrated in the present embodiment is the one where a thin film is formed on the dielectric, but, instead of this, the antenna 9 may be configured only with a conductive plate-shaped member, or may be configured by combining the base part 94 with the conductive plate-shaped member. Examples of the planar emitting electrode 91 include both the one configured with a thin film and the one formed into a plate shape. Also, examples of the planar short-circuit part 92 and the connecting part 93 include both the ones configured with a thin film and the ones formed into a plate shape. Furthermore, the planar emitting electrode 91, the short-circuit part 92, and the connect-ng part 93 also includes a configuration where they have an uneven part on the whole or part of their surfaces.

The shape of the emitting electrode 91 of the present embodiment is rectangular. The emitting electrode 91 is disposed, on the front surface 94*a*, to cover a most region of the front surface 94*a*. The emitting electrode 91 is disposed to expose an edge part of the front surface 94*a* in a U shape. More specifically, a partial region inside in the radial direction of the front surface 94*a* and regions at both ends in the width direction thereof are exposed. Each side of the emitting electrode 91 is parallel to the corresponding side of the front surface 94*a*. Note that the emitting electrode 91 may be provided to prevent the exposure of the front surface 94*a*, in other words, cover the whole of the front surface 94*a*.

Note that, in the description of the antenna 9 and the ground layer 70 in the present specification, the "width direction" is a direction perpendicular to an extension direction of the emitting electrode 91. For example, the emitting electrode 91 of the present embodiment extends from the short-circuit part 92 along the radial direction. The "extension direction" in this case is a direction of the perpendicular line that links the center axis line X1 to the line of the perpendicular line 70*p*. The width direction is a direction perpendicular to this perpendicular line, and, for example, a direction parallel to the first side 70*a* of the ground layer 70.

The emitting electrode 91 has first emitting sides 91*a* and 91*a*, and a second emitting side 91*b*. The first emitting sides 91*a* are sides along the radial direction of the emitting electrode 91. One of the first emitting sides 91*a* and the other of the first emitting sides 91*a* are generally parallel or substantially parallel. The second emitting side 91*b* is a side substantially perpendicular to the first emitting sides 91*a* of the emitting electrode 91, in other words, a side along the width direction. The substantial antenna length of the emitting electrode 91 is the length of a side from a point 91*c*, to which the short-circuit part 92 is connected, to the second emitting side 91*b*, i.e., the length of the first emitting sides 91*a* and 91*a*. The emitting electrode 91 is formed so that, for example, the antenna length is a length of ¼ of the substantial wavelength λ' after shortening. The antenna 9 of the present embodiment has characteristics of a planar monopole antenna. More specifically, in the antenna 9 of the present embodiment, each of the first emitting sides 91*a* and 91*a* exhibits antenna characteristics similar to a monopole antenna. The first emitting sides 91*a* and 91*a* have directivity along the direction of the center axis line X1. That is to say, the first emitting sides 91*a* and 91*a* have high sensitivity to a radio wave along the direction of the center axis line X1.

The short-circuit part 92 is disposed on the first side surface 94*c* of the base part 94. The first side surface 94*c* a surface facing outside in the radial direction of the base part 94. The short-circuit part 92 is a planar constituent part formed of a material having conductivity, such as metal. For example, the shape of the short-circuit part 92 is rectangular. The short-circuit part 92 extends from the upper end of the first side surface 94*c* to the lower end thereof. The short-circuit part 92 is disposed to expose both end parts in the width direction of the first side surface 94*c*. The upper end of the short-circuit part 92 leads to the emitting electrode 91 and is electrically connected with the emitting electrode 91. The lower end of the short-circuit part 92 is electrically connected with the ground layer 70. In the present embodiment, the width WE of the short-circuit part 92 is equal to the width. WE of the emitting electrode 91.

The connecting part 93 is disposed on the second side surface 94*d* of the base part 94. The second side surface 94*d* is a surface facing inside in the radial direction of the base part 94. The connecting part 93 is a planar constituent part formed of a material having conductivity, such as metal. For example, the shape of the connecting part 93 is rectangular. The connecting part 93 extends from an end part on a back surface 94*b* side of the second side surface 94*d* to a position relatively on the front side as compared with the center. The connecting part 93 is an RF connecting part and connected to the receiving circuit 15. In the antenna 9 of the present embodiment, the connecting part 93 is capacitively coupled to the emitting electrode 91. The connecting part 93 and the emitting electrode 91 are separated without physical contact. The capacitive coupling of the connecting part 93 and the emitting electrode 91 achieves non-contact-type signal transmission. Impedance matching is achieved based on the distance between an end part on the front side of the connecting part 93 and the second emitting side 91*b*. Note that power may be supplied by directly connecting the connecting part 93 with the emitting electrode 91.

The base part 94 is supported by the substrate 7 so that its back surface 94*b* contacts with the ground layer 70. The hack surface 94*b* is opposed to an inside region in the radial direction of the ground layer 70. The first side surface 94*c* of the base part 94 is parallel to the first side 70*a* of the ground layer 70, and the second side surface 94*d* of the base part 94 is parallel to the fourth side 70*d* of the ground layer 70. To prevent the ground layer 70 from being electrically connected with the connecting part 93, the connecting part 93 and a connected electrode 75 (see FIG. 3) are disposed at a predetermined distance to the ground layer 70. The connecting part 93 is connected to the receiving circuit 15 via the electrode 75. It is preferable for the electrode 75 to be made as small as possible in terms of reducing influence on the impedance of the antenna 9. Furthermore, it is preferable for the distance between the electrode 75 and the ground layer 70 to be separated as far as possible. Furthermore, it is preferable for the electrode 75 and the ground layer 70 not to overlap in a planar manner.

As illustrated in FIG. 3 and other figures, the ground layer 70 of the present embodiment has a first region 71 and a second region 72. The first region 71 is an inside region in the radial direction relative to the short-circuit part 92. The second region 72 is an outside region in the radial direction relative to the short-circuit part 92. The first region 71 and the second region 72 are continuous and constitute the single ground layer 70. In the ground layer 70 of the present embodiment, the shape of the first region 71 and the shape of the second region 72 are the same. That is to say, the ground layer 70 has a symmetric shape with reference to the short-circuit part 92. More specifically, a length LG1 of the first region 71 in the radial direction is equal to a length LG2 of the second region 72 in the radial direction. Also, the width of the first region 71 and the width of the second region 72 are the same. Thus, the area of the first region 71 is equal to the area of the second region 72.

As described with reference to FIG. 5, the radio wave watch 1 of the present embodiment enables the reception sensitivity of the antenna 9 to be improved with the image antenna 9*i*. The image antenna 9*i* is a virtual antenna and paired with the antenna 9. It is thought that the image antenna 9*i* is generated on the opposite side to the emitting electrode 91 side across the short-circuit part 92. The image antenna 9*i* is generated in a shape symmetric to the antenna 9 and at a position symmetric to it with reference to the short-circuit part 92.

The image antenna 9*i* includes a virtual electrode 91*i*. The virtual electrode 91*i* is a virtual constituent part formed, by an image effect, at the position symmetric to the emitting electrode 91 with reference to the short-circuit part 92. The virtual electrode 91*i* extends from the short-circuit part 92 toward the outside in the radial direction and is opposed to the second region 72 of the ground layer 70.

In the present embodiment, no components are disposed in the space part where the image antenna 9*i* is generated. In other words, the exclusive space for generating the image antenna 9*i* secured. Furthermore, the ground layer 70 is symmetrically formed with reference to the short-circuit part 92. That is, the electrical symmetricity between the inside region in the radial direction and the outside region in the radial direction is secured with reference to the short-circuit part 92. This generates the image antenna 9*i* having high symmetricity to the antenna 9. As a result, the radio wave watch 1 of the present embodiment enables the reception sensitivity of the antenna 9 to be improved to the maximum. However, a mounted object may be disposed in the region where the image antenna 9*i* is generated. Disposing the mounted object in the region for generating the image antenna 9*i* enables a power-supplying line to the mounted object to be shortened, and can decrease the influence of wiring capacity and reducing propagation loss.

Referring to FIGS. 6 to 16, the reception sensitivity of the antenna 9 of the radio wave watch 1 of the present embodiment will be described.

Figure 6:
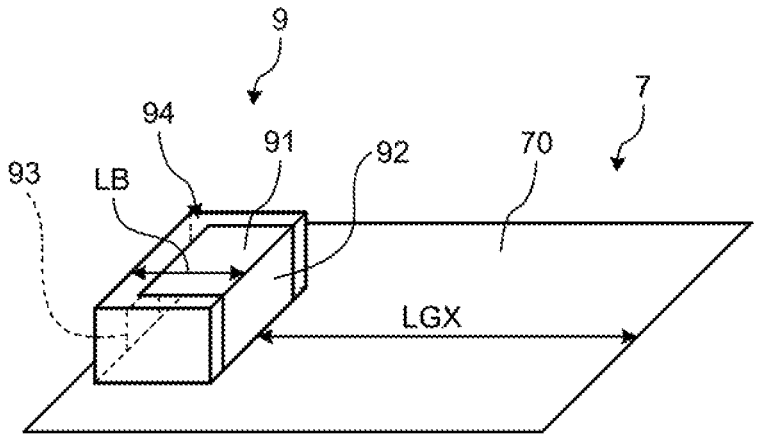
FIG. 6 is a perspective view illustrating a first placement of the antenna.
Figure 7:
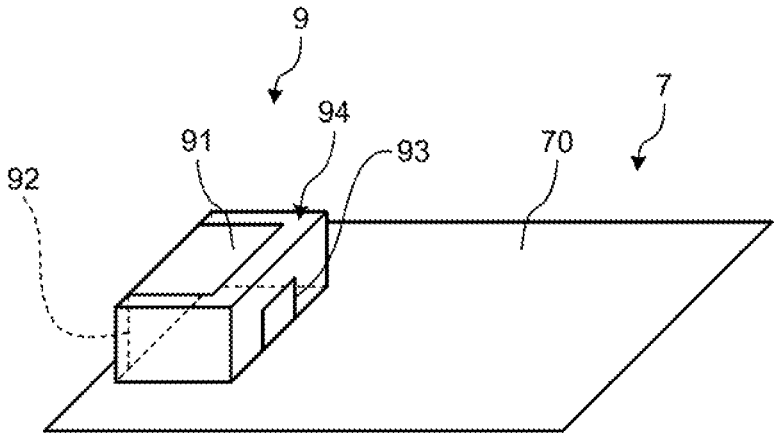
FIG. 7 is a perspective view illustrating a second placement of the antenna.

One example of a placement of the antenna 9 on the ground layer 70 is illustrated in FIGS. 6 and 7. Each antenna 9 in FIGS. 6 and 7 is disposed at an end part of the ground layer 70, and the positions of their short-circuit part 92 are different. In the antenna 9 illustrated in FIG. 6, the short-circuit part 92 faces the central side of the ground layer 70, similarly to the placement of the radio wave watch 1 of the present embodiment. In other words, the ground layer 70 extends frontward from the short-circuit part 92, in the placement of the antenna 9 in FIG. 6. A length LGX of the ground layer 70 extending forward from the short-circuit part 92 is twice or more than a length LB of the base part 94.

In contrast, the short-circuit part 92 of the antenna 9 illustrated in FIG. 7 faces the opposite side to the central side of the ground layer 70. In this case, no ground layer 70 substantially exists forward from the short-circuit part 92. That is, FIGS. 6 and FIG. 7 have the difference of whether the ground layer 70 is provided forward from the short-circuit part 92. In the following description, the placement of the antenna 9 in FIG. 6 is referred to as a "first placement", and the placement of the antenna 9 in FIG. 7 is referred to as a "second placement".

Figure 8:
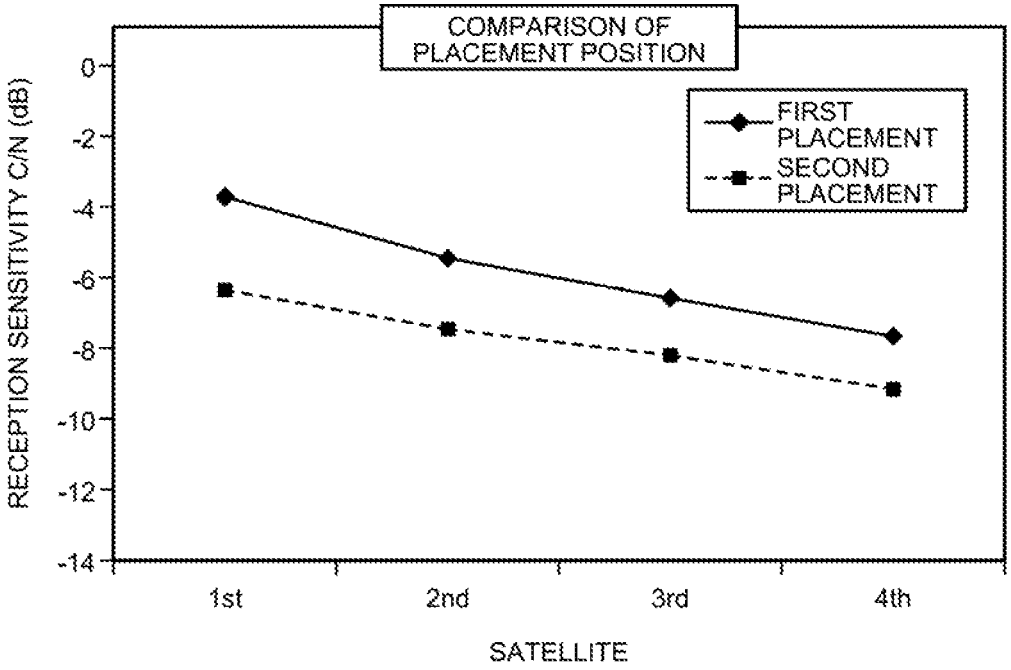
FIG. 8 is a view illustrating the sensitivity of the antenna in the first placement and the second placement.

FIG. 8 illustrates the sensitivity of the antenna 9 in the first placement and the second placement. In FIG. 8, the vertical axis represents the reception sensitivity C/N [dB] of the antenna 9. FIG. 8 illustrates the sensitivity to a radio wave received from four GPS satellites. As is apparent from FIG. 8, the reception sensitivity in the first placement is better than the reception sensitivity in the second placement. That is, it is found that the reception sensitivity of the antenna 9 in the case where the ground layer 70 exists forward from the short-circuit part 92 is improved as compared with the case where no ground layer 70 exists. It is considered that this is because the ground layer 70 forward from the short-circuit part 92 results in forming the image antenna 9*i* having high symmetricity to the antenna 9.

Figure 9:
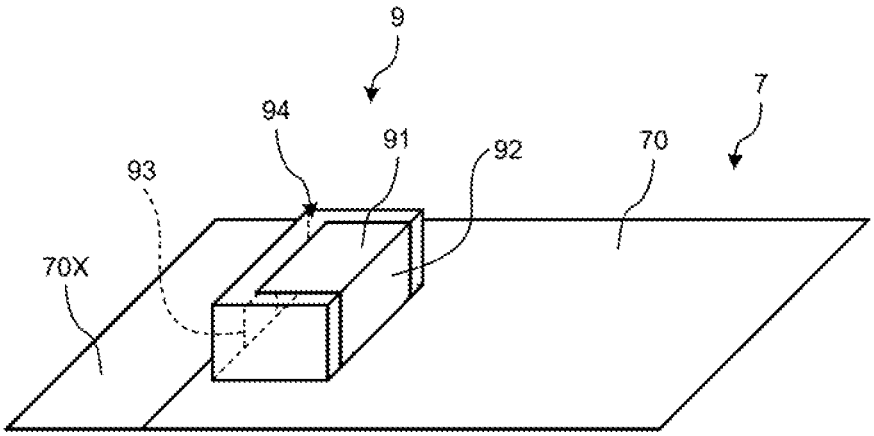
FIG. 9 is a perspective view illustrating a configuration where a ground layer is extended in the first placement.
Figure 10:
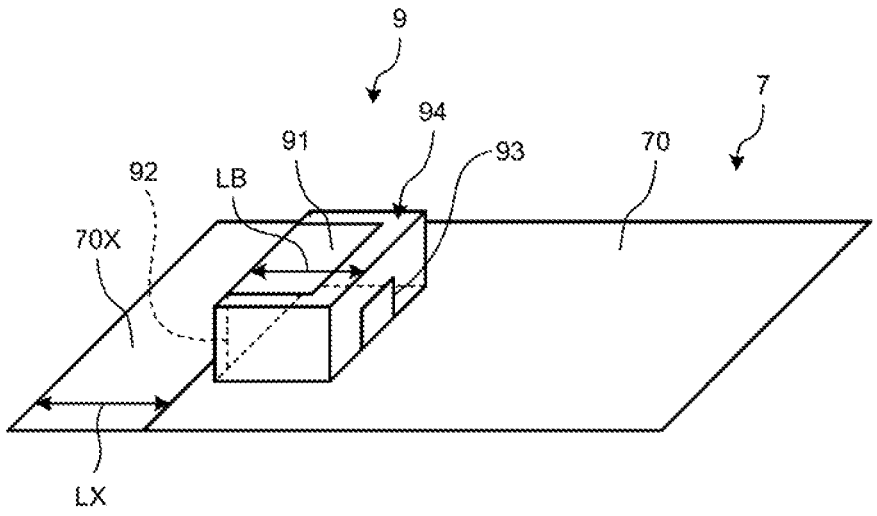
FIG. 10 is a perspective view illustrating a configuration where a ground layer is extended in the second placement.

Next, a change in the sensitivity in the case where the ground layer 70 is added in the first placement and the second placement will be described. FIG. 9 is a view illustrating a configuration where the ground layer is extended in the first placement, and FIG. 10 is a perspective view illustrating a configuration where the ground layer is extended in the second placement. The ground layer 70 illustrated in FIGS. 9 and 10 has an extension part 70X. The extension part 70X is a part where the end part of the ground layer 70, on the side where the antenna 9 is disposed, is extended. As illustrated in FIG. 9, the extension part 70X in the first placement extends frontward from the connecting part 93. In other words, the part, of the ground layer 70, disposed forward from the short-circuit part 92 has no change from that in FIG. 6.

In contrast, the extension part 70X in the second placement extends forward from the short-circuit part 92, as illustrated in FIG. 10. That is, the ground layer 70 is added forward from the short-circuit part 92 as compared with the configuration in FIG. 7. The length LX of the extension part 70X is similar to the length LB of the base part 94.

Figure 11:
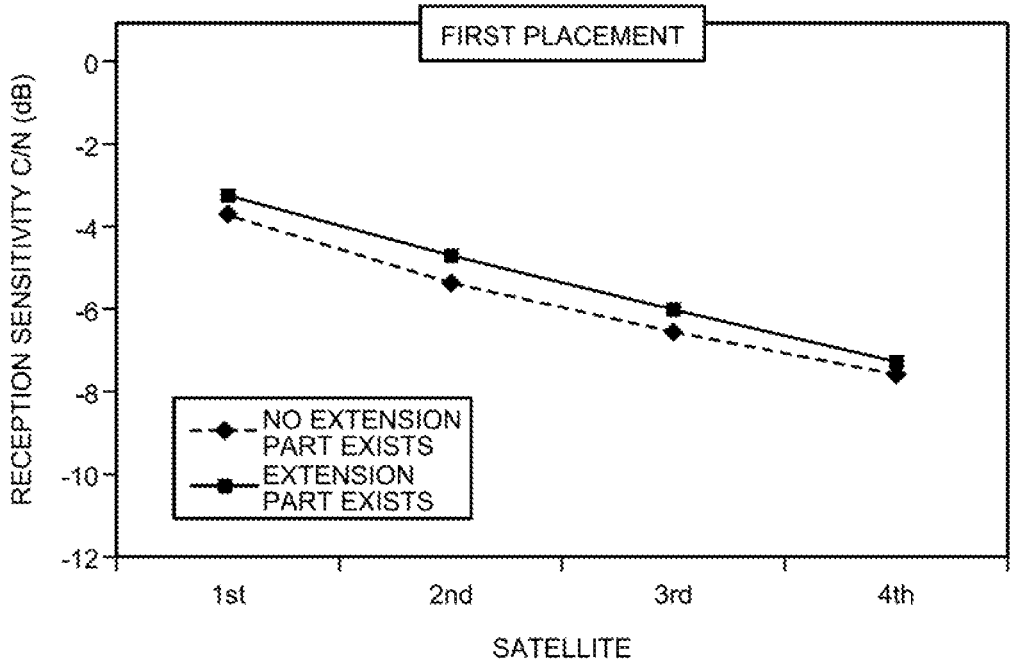
FIG. 11 is a view illustrating a measurement result of the reception sensitivity in the first placement.
Figure 12:
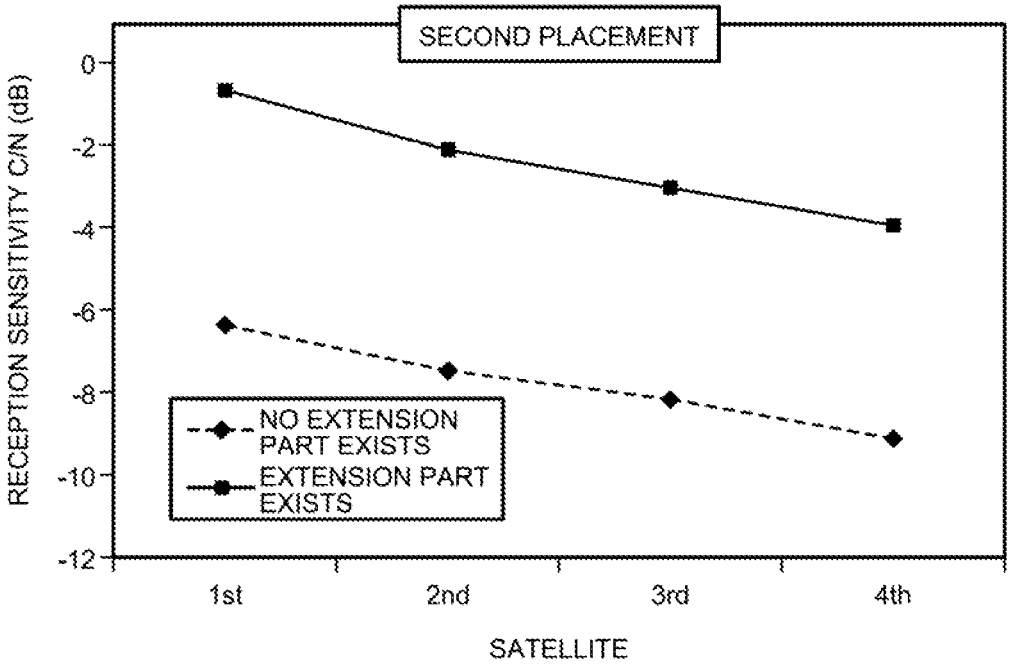
FIG. 12 is a view illustrating a measurement result of the reception sensitivity in the second placement.

FIG. 11 illustrates a measurement result of the reception sensitivity in the first placement. FIG. 12 illustrates a measurement result of the reception sensitivity in the second placement. FIG. 11 illustrates, in the first placement, the reception sensitivity in the case where no extension part 70X is provided (FIG. 6) and the reception sensitivity in the case where the extension part 70X is provided (FIG. 9). FIG. 12 illustrates, in the second placement, the reception sensitivity in the case where no extension part 70X is provided (FIG. 7) and the reception sensitivity in the case where the extension part 70X is provided (FIG. 10).

As illustrated in FIG. 11, the presence or absence of the extension part 70X in the first placement has no large influence on the reception sensitivity of the antenna 9. In contrast, as illustrated in FIG. 12, the presence or absence of the extension part 70X in the second placement have significant influence on the reception sensitivity of the antenna 9. In the case where the extension part 70X is provided, the reception sensitivity is significantly improved as compared with the case where no extension part 70X is provided.

As is apparent from the above result, disposing the ground layer 70 on the opposite side to the emitting electrode 91 side across the short-circuit part 92 improves the sensitivity of the antenna 9. It is considered that this improvement in the reception sensitivity arises from that the ground layer 70 disposed forward from the short-circuit part 92 secures the symmetricity between the antenna 9 and the image antenna 9*i*. That is to say, in the ground layer 70, it is considered that the enhanced symmetricity of both sides across the short-circuit part 92 enables the reception sensitivity of the antenna 9 to be improved.

Figure 13:
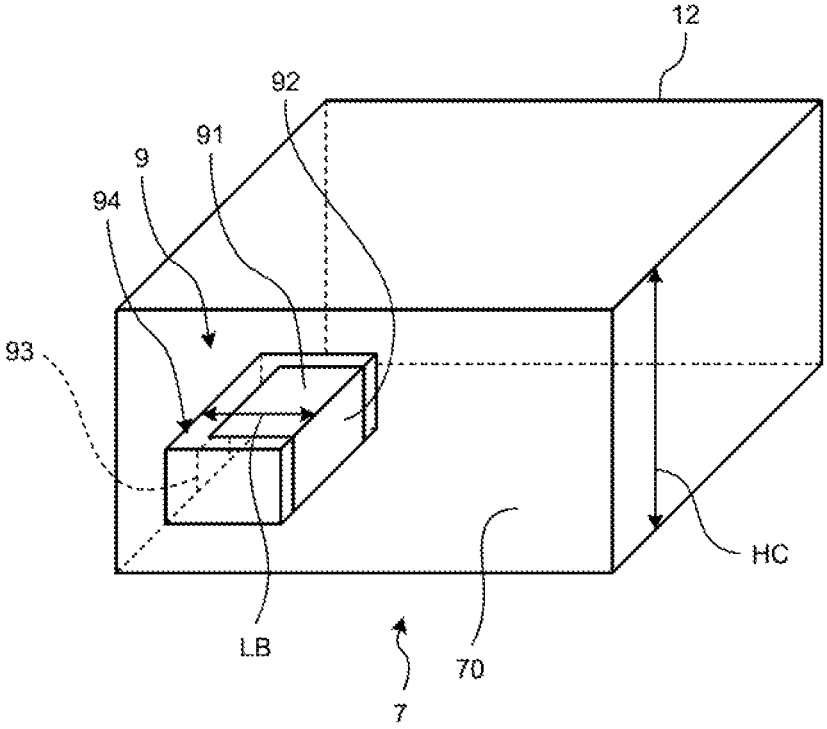
FIG. 13 is a perspective view illustrating a configuration having a surrounding metal cover in the first placement.
Figure 14:
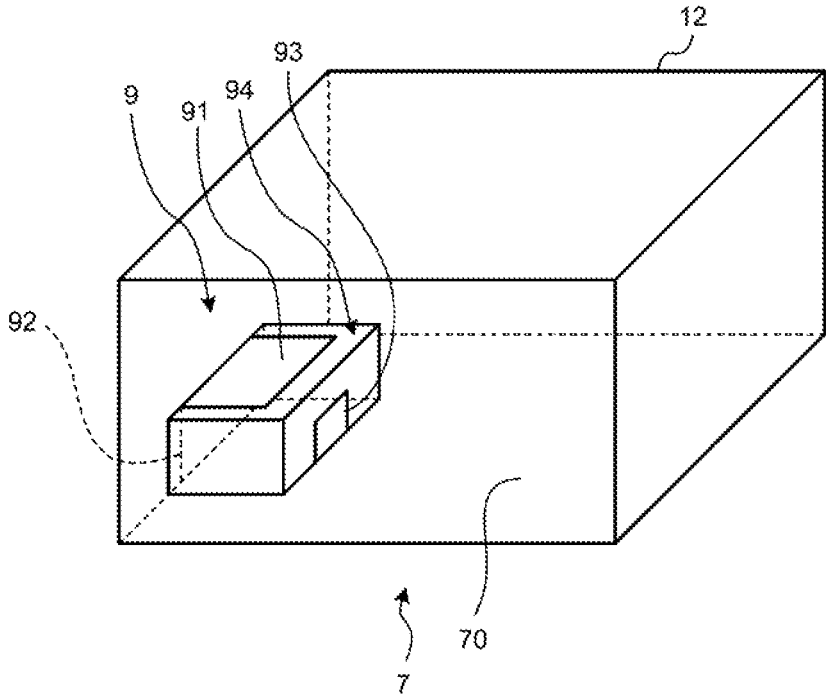
FIG. 14 is a perspective view illustrating a configuration having the surrounding metal cover in the second placement.

Next, the influence of a surrounding metal member on the reception sensitivity of the antenna 9 will be described. FIG. 13 illustrates a configuration where a metal cover 12 is put on in the first placement. FIG. 14 illustrates a configuration where the metal cover 12 is put on in the second placement. The cover 12 is a box-shaped member configured with metal having conductivity. The cover 12 covers the surroundings of the ground layer 70 and the antenna 9. The cover 12 is electrically connected with the ground layer 70. A height HC of the cover 12 is approximately twice the length LB of the base part 94.

Figure 15:
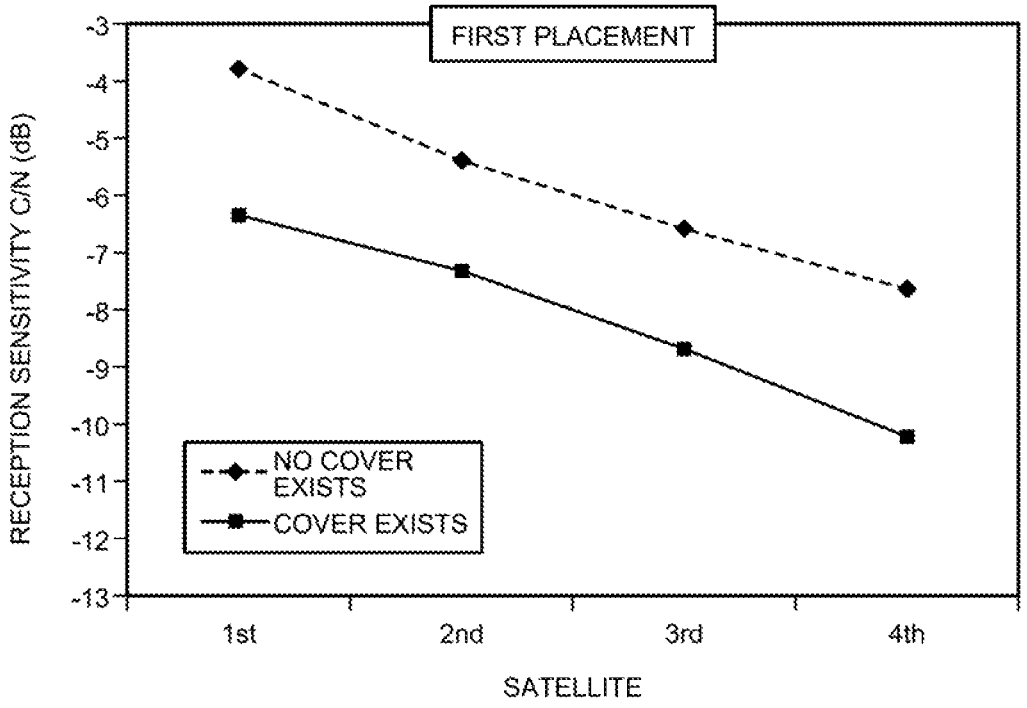
FIG. 15 is a view illustrating a measurement result of the reception sensitivity in the first placement.
Figure 16:
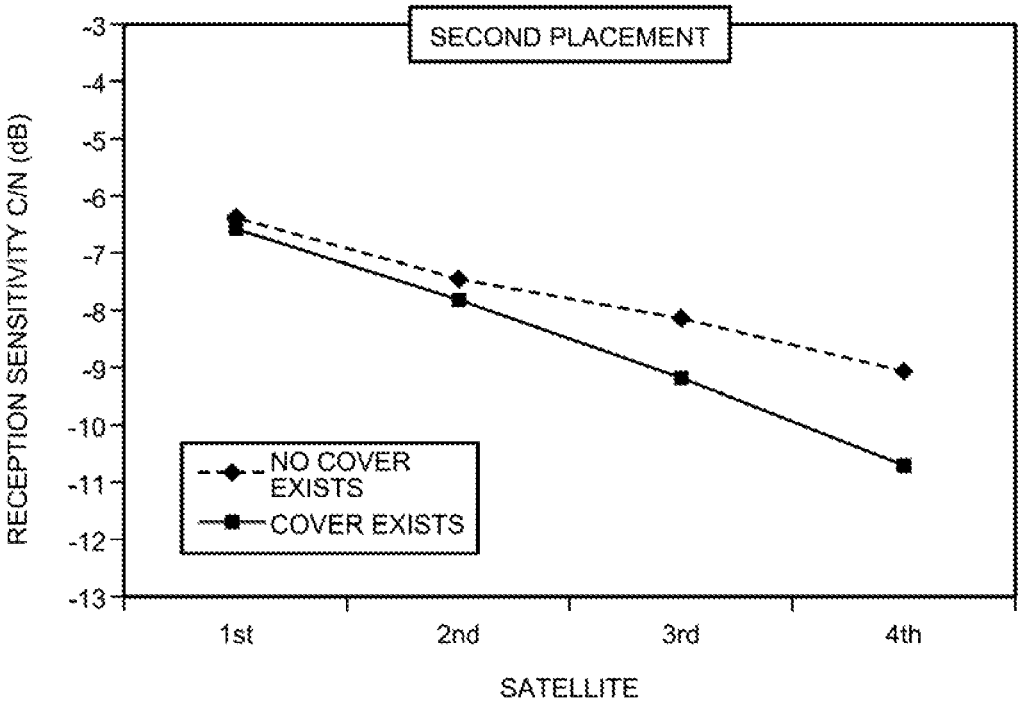
FIG. 16 is a view illustrating a measurement result of the reception sensitivity in the second placement.

FIG. 15 illustrates a measurement result of the reception sensitivity in the first placement. FIG. 16 illustrates a measurement result of the reception sensitivity in the second placement. FIG. 15 illustrates, in the first placement, the reception sensitivity in the case where no cover 12 is provided (FIG. 6) and the reception sensitivity in the case where the cover 12 is provided (FIG. 13). FIG. 16 illustrates, in the second placement, the reception sensitivity in the case where no cover 12 is provided (FIG. 7) and the reception sensitivity in the case where the cover 12 is provided (FIG. 14).

As illustrated in FIG. 15, the presence or absence of the cover 12 in the first placement have significant influence on the reception sensitivity of the antenna 9. In the case where the cover 12 is provided in the first placement, the reception sensitivity significantly drops as compared with the case where no cover 12 is provided. In contrast, the presence or absence of the cover 12 in the second placement has influence on the reception sensitivity to some extent. In the case where the cover 12 is provided in the second placement, the reception sensitivity also drops as compared with the case where no cover 12 is provided. However, the degree of drop in the reception sensitivity in the second placement is smaller than the degree of drop in the reception sensitivity in the first placement. That is, it is said that the second placement has high tolerance to the metal enclosure as compared with the first placement.

In the first placement, it is considered that the connecting part 93, which is capacitively coupled to the emitting electrode 91, is disposed near the cover 12, which is the metal member, and thus the reception sensitivity drops under the influence of the metal of the cover 12.

In the radio wave watch 1 of the present embodiment, each component is disposed so that the metal member does not cover the antenna 9 and the image antenna 9*i* from above. For example, as illustrated in FIGS. 3 and 5, the solar cell 6 is disposed not to cover the second region 72 of the ground layer 70 and the antenna 9 from above. More specifically, an end surface 6*a* of the solar cell 6 is located inside in the radial direction relative to the emitting electrode 91. That is, the solar cell 6 is disposed not to overlap with at least, the emitting electrode 91 when viewed in the axial direction. The radio wave watch 1 of the present embodiment thus enables the reception sensitivity of the antenna 9 to be improved.

Figure 17:
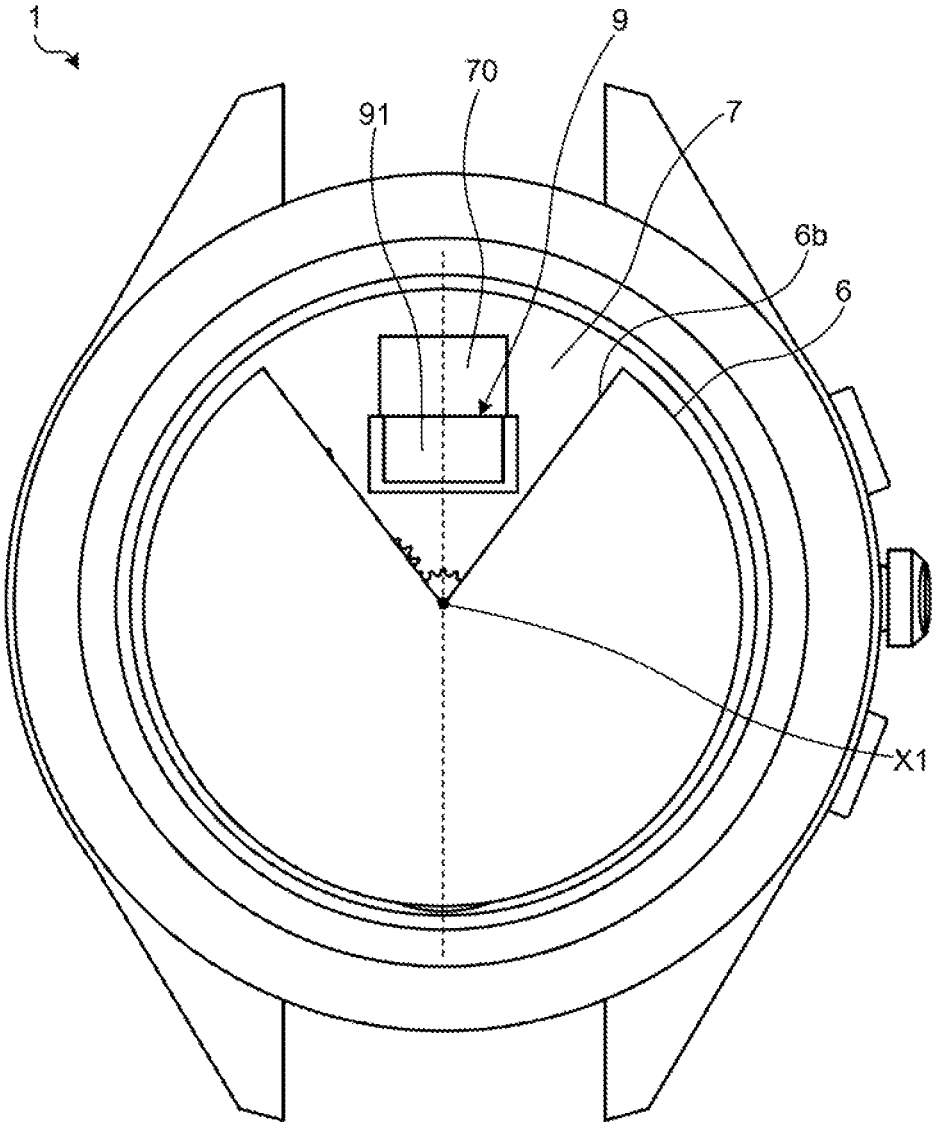
FIG. 17 is a plan view illustrating a placement example of a solar cell.

The solar cell 6 may be configured as illustrated in FIG. 17. FIG. 17 is a plan view illustrating a placement example of the solar cell. The shape of the solar cell 6 illustrated in FIG. 17 is a shape where a part of its disk is notched. The solar cell 6 has a sector-shaped notch part 6*b*. The width of the notch part 6*b* becomes wider as it goes outside in the radial direction from the center axis line X1. The shape and placement of the notch part 6*b* are determined so that the solar cell 6 does not overlap with the antenna 9 and the ground layer 70 when viewed in the axial direction. That is, the notch part 6*b* is formed so that the solar cell 6 does not shield the front side of the antenna 9 and the ground layer 70.

Figure 18:
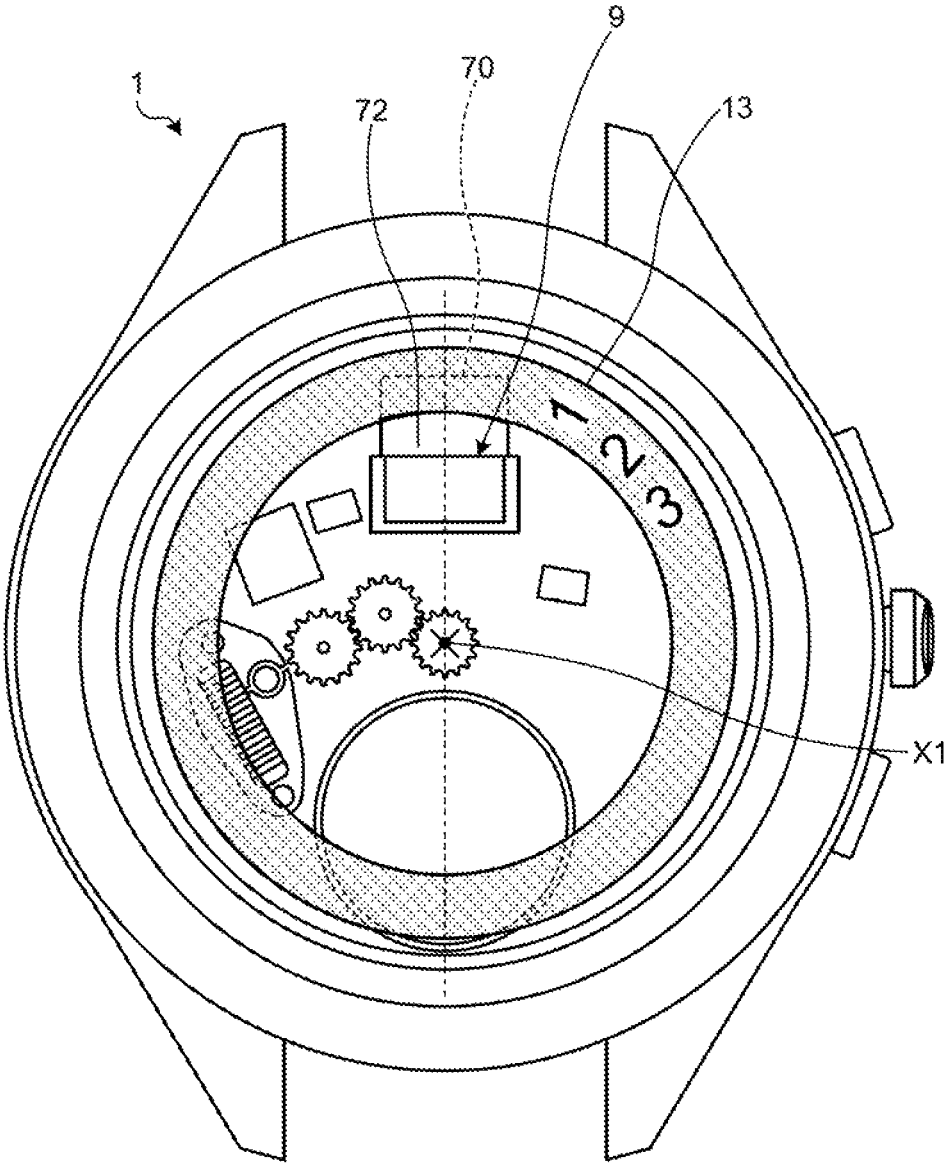
FIG. 18 is a plan view illustrating a placement example of a date plate.

Note that a non-conductive member may be disposed on the front side of the ground layer 70. FIG. 18 is a plan view illustrating a placement example of a date plate. In the case where a date plate 13 disposed in the radio wave watch 1 is a non-conductive member, the date plate 13 may overlap with the ground layer 70 when viewed in the axial direction. For example, the date plate 13 is disposed coaxially with the center axis line X1. For example, the date plate 13 is disposed to overlap with the second region 72 of the ground layer 70 and not to overlap with the antenna 9. In other words, the date plate 13 is disposed outside in the radial direction relative to the antenna 9. It is considered that the non-conductive member is unlikely to affect the symmetricity between the antenna 9 and the image antenna 9*i* even when it is disposed at a position opposed to the ground layer 70. However, in view of the thickness of the whole watch, it, is preferable for it to be disposed not to overlap with the antenna 9.

Figure 19:
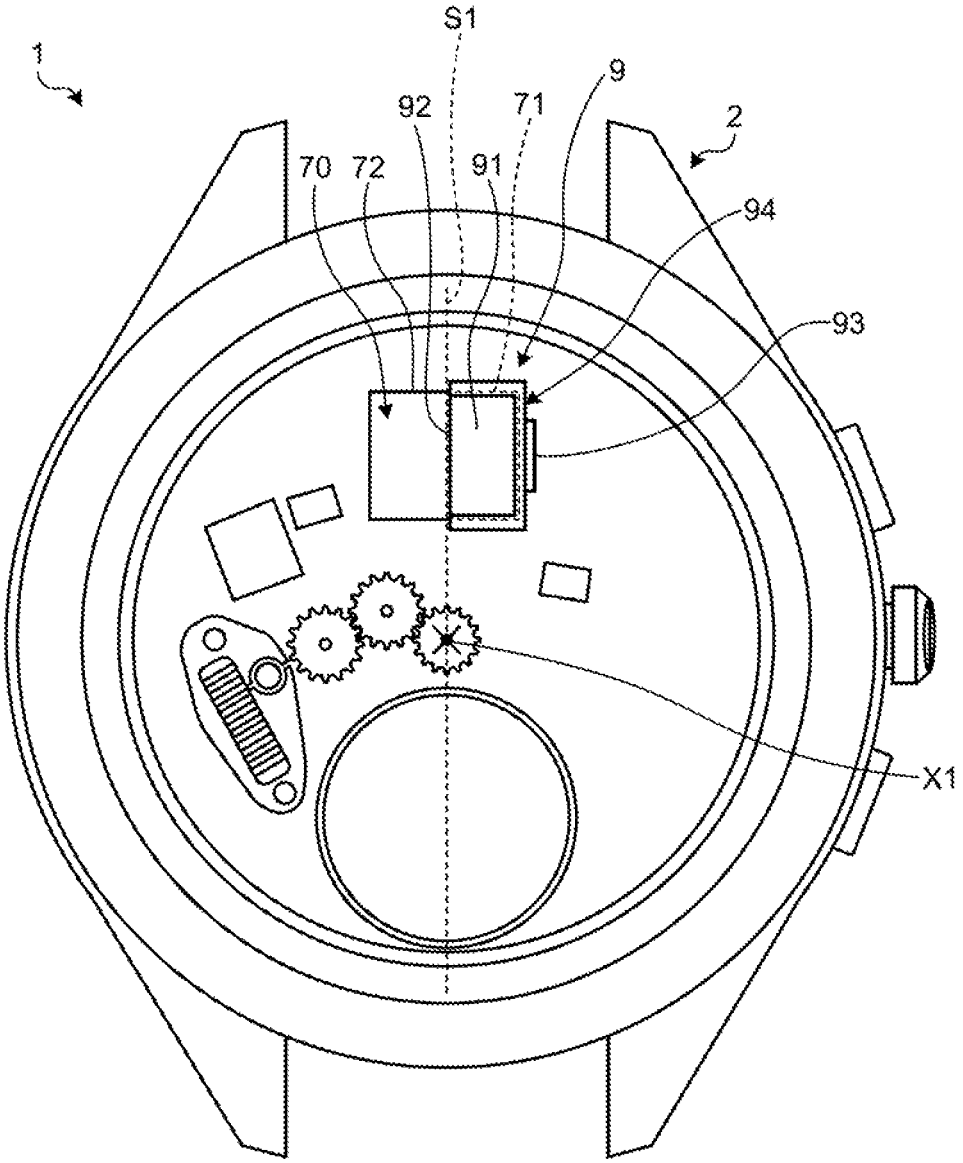
FIG. 19 is a plan view illustrating another placement, example of the antenna.

Another placement example of the antenna 9 will be described. FIG. 19 is a plan view illustrating another placement example of the antenna. In the placement illustrated in FIG. 19, the short-circuit part 92 of the antenna 9 is disposed to face in the circumferential direction. In other words, the emitting electrode 91 extends from the short-circuit part 92 along the circumferential direction, in the placement illustrated in FIG. 19. The second region 72 of the ground layer 70 extends from the antenna 9 toward the opposite side to the emitting electrode 91 side along the circumferential direction.

For example, the antenna 9 is disposed so that the short-circuit part 92 is located on a virtual plane S1. The virtual plane S1 is a plane including the center axis line X1. In other words, the antenna 9 is disposed so that the short-circuit part 92 extends along the virtual plane S1 in the radial direction. In this case, the ground layer 70 is disposed to be symmetric with reference to the virtual plane S1. That is, in the ground layer 70, the first region 71 and the second region 72 are located on the different sides across the virtual plane S1.

The placement as illustrated in FIG. 19 also enables the reception sensitivity of the antenna 9 to be improved by the effect of the image antenna 9*i*.

Figure 20:
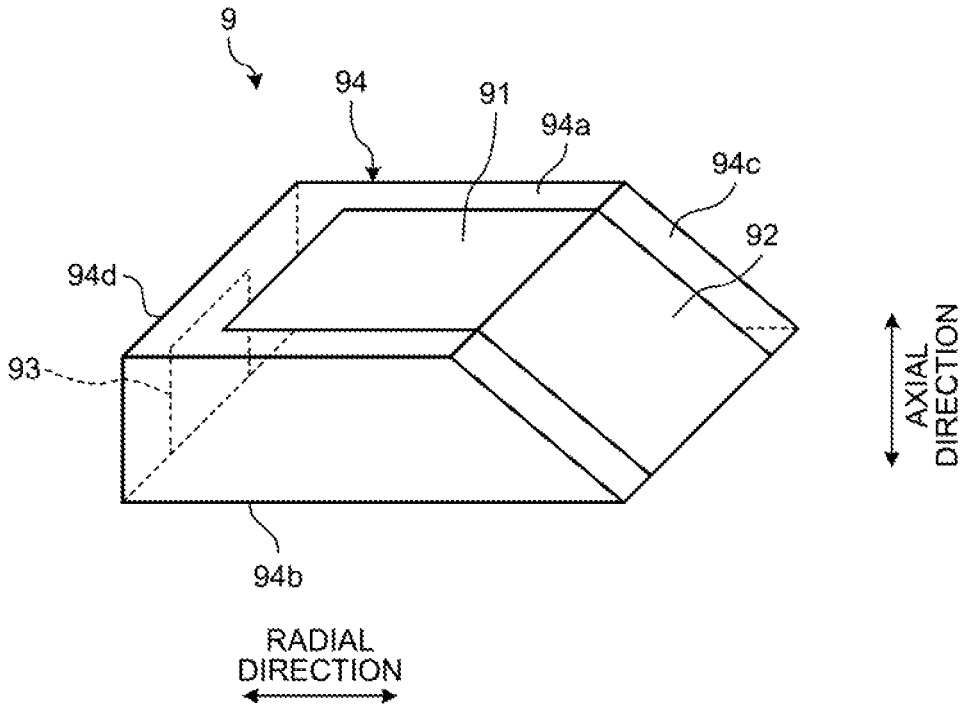
FIG. 20 is a perspective view illustrating one example of the shape of the antenna.

Another shape of the antenna 9 will be described. FIG. 20 is a perspective view illustrating one example of the shape of the antenna. In the antenna 9 illustrated in FIG. 20, the first side surface 94*c* of the base part 94 is an inclined surface. The first side surface 94*c* is inclined to approach the second side surface 94*d* as it goes from the back surface 94*b* side to the front surface 94*a* side. The short-circuit part 92 is inclined similarly to the first side surface 94*c*. Various shapes other than the illustrated one can be adopted as the shape of the antenna 9.

As discussed above, the radio wave watch 1 according to the present embodiment has the exterior case 2, the dial plate 4, the substrate 7, the first region 71 of the ground layer 70, the antenna 9, and the second region 72 of the ground layer 70. The dial plate 4 is disposed within the exterior case 2. The first region 71 of the ground layer 70 corresponds to a first ground layer disposed on the substrate 7. The antenna 9 is disposed between the center axis line X1, which is the center of the exterior case 2, and the inner wall surface 21*a* of the exterior case 2. The antenna 9 has the planar emitting electrode 91, the planar short-circuit part 92, and the connecting part 93. The emitting electrode 91 is opposed to the first region 71 of the ground layer 70. The short-circuit part 92 electrically connects the end part of the emitting electrode 91 with the first region 71 of the ground layer 70. The connecting part 93 connects the emitting electrode 91 with the receiving circuit 15 of the substrate 7.

The second region 72 of the ground layer 70 corresponds to a second ground layer disposed on the substrate 7. The second region 72 is disposed on the opposite side to the emitting electrode 91 side across the short-circuit part 92 on the substrate 7. The width WG of the second region 72 is equal to or greater than the width WS of the short-circuit part 92. The antenna 9 of the present embodiment improves, with the second region 72 of the ground layer 70, the symmetricity between the image antenna 9*i* and the antenna 9. Thus, the antenna 9 of the present embodiment can achieve improving its reception sensitivity.

In the antenna 9 of the present embodiment, the first region 71 as the first ground layer and the second region 72 as the second ground layer are integrated with each other. The integration of the first region 71 and the second region 72 facilitates improving the symmetricity between the image antenna 9*i* and the antenna 9. Furthermore, the configuration of the ground layer 70 is simplified.

In the antenna 9 of the present embodiment, the emitting electrode 91 extends from the short-circuit part 92 toward the radial direction, which is a direction perpendicular to the center axis line X1 of the exterior case 2. Such a placement easily secures the symmetricity of the emitting electrode 91 in positional relationship with the inner wall surface 21*a* of the exterior case 2.

In the antenna 9 of the present embodiment, the second region 72 of the ground layer 70 extends from the short-circuit part 92 toward the opposite side to the emitting electrode 91 side. The length LG2 of the second region 72 in this extension direction is equal to or greater than a length LE of the emitting electrode 91. Thus, the second region 72 of the present embodiment can improve the symmetricity between the image antenna 9*i* and the antenna 9.

Note that the length LG2 of the second region 72 may be less than the length LE of the emitting electrode 91. For example, the length LG2 of the second region 72 is determined depending on the size of a region to be secured. In the ground layer 70, the shape of the first side 70*a* may be an arc shape corresponding to the shape of the inner wall surface 21*a* of the exterior case 2, instead of the straight shape. This enables a limited space to be effectively utilized to enhance the symmetricity between the first region 71 and the second region 72.

In the antenna 9 of the present embodiment, the metal member is disposed in a region not overlapping with the emitting electrode 91 in the direction of the center axis line X1 of the exterior case 2, in the space between the dial plate 4 and the substrate 7. For example, the solar cell 6 is disposed in the region not overlapping with the emitting electrode 91 when viewed in the axial direction, as illustrated in FIG. 17. The drive source 56 and the wheel train 54 are also disposed in the region not overlapping with the emitting electrode 91 when viewed in the axial direction. Disposing the metal member in the region not overlapping with the emitting electrode 91 enables the reception sensitivity of the antenna 9 to be improved.

Figure 21:
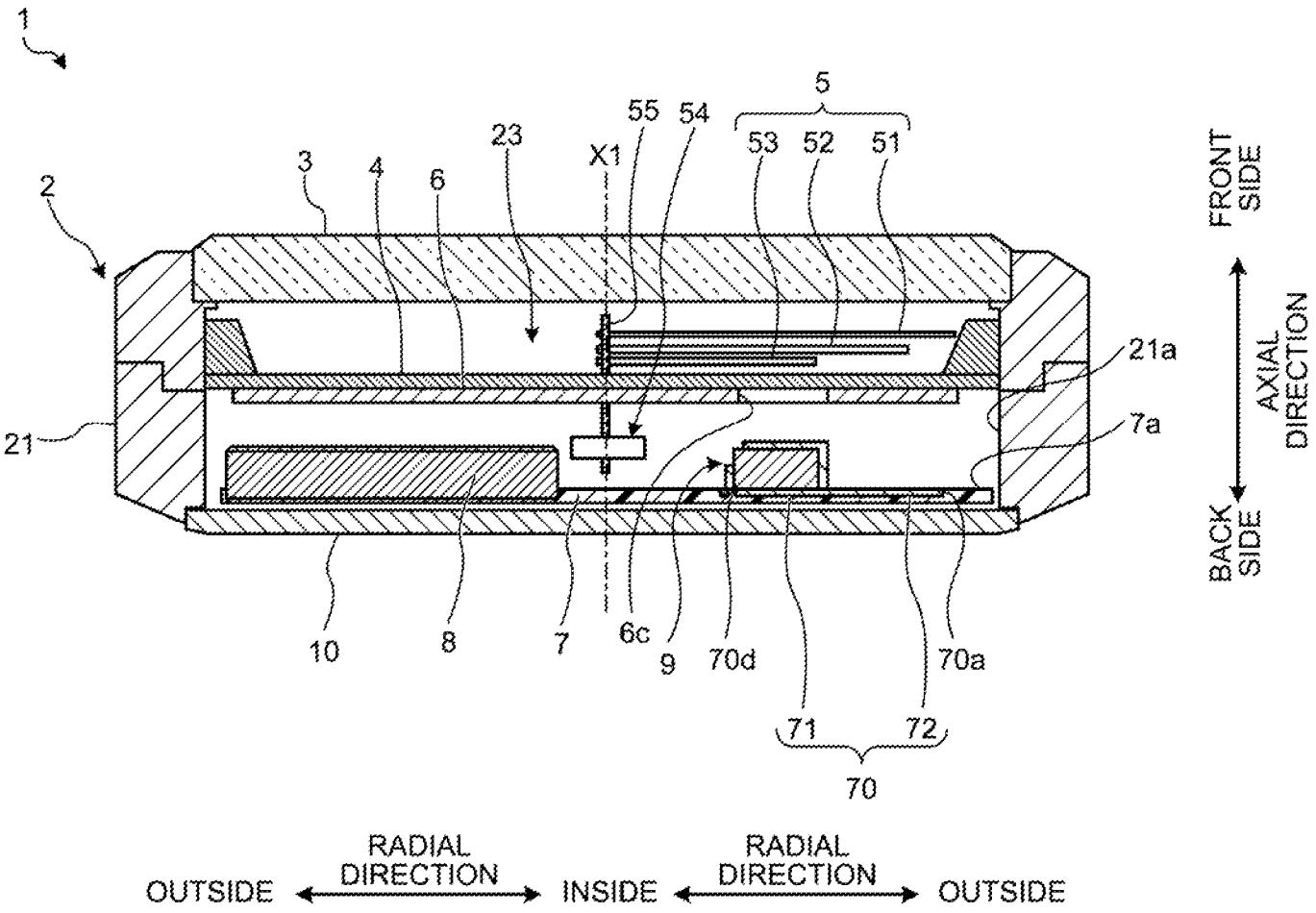
FIG. 21 is a sectional view illustrating the solar cell disposed to overlap with a second region.

In the antenna 9, the metal member may be disposed in a region overlapping with the second region 72. The metal member disposed in the region overlapping with the second region 72 is, for example, the solar cell 6, the drive source 56, a magnetic shield, and the wheel train 54. FIG. 21 illustrates the solar cell 6 disposed to overlap with the second region 72. The solar cell 6 is opposed to the second region 72 of the ground layer 70 in the axial direction. The solar cell 6 has an opening part 6*c* at a position opposed to the emitting electrode 91. For example, the shape of the opening part 6*c* is rectangular. The opening part 6*c* is provided in a range overlapping with the emitting electrode 91 when viewed in the axial direction. The opening width and the opening length of the opening part 6*c* may be greater than the width WE and the length LE of the emitting electrode 91, respectively. Disposing the solar cell 6 also in the region overlapping with the second region 72 can achieve maximizing the light-receiving area of the solar cell 6 while achieving improvement in the reception sensitivity of the antenna 9.

Note that, in FIG. 21, the solar cell 6 overlaps with the whole region of the second region 72, but it is not limited to this. The solar cell 6 may overlap with a partial region of the second region 72. In the solar cell 6, the region overlapping with the second region 72 may have an opening, a slit, or other empty spaces. For example, a part of the opening part 6*c* may be formed to overlap with the second region 72 when viewed in the axial direction.

The solar cell 6 above the antenna 9 may have the notch part 6*b* as illustrated in FIG. 17. In the case where the solar cell 6 is disposed between the dial plate 4 and the substrate 7, it is preferable for the solar cell 6 to be disposed without causing the drop in the reception sensitivity of the antenna 9. The solar cell 6 illustrated in FIG. 17 has the notch part 6*b* at a position opposed to the emitting electrode 91 and the second region 72. The notch part 6*b* includes a range overlapping with the emitting electrode 91 and the second region 72 when viewed in the axial direction. The solar cell 6 does not shield the front side of the emitting electrode 91 and the second region 72, so that the drop in the reception sensitivity of the antenna 9 is reduced.

In the space between the dial plate 4 and the substrate 7, a non-conductive member may be disposed to be opposed to the second region 72. For example, in the case where the wheel train 54 is a non-conductive member, the wheel train 54 may be disposed to be opposed to the second region 72. The non-conductive member is disposed to be opposed to the second region 72 in this way, so that the space between the second region 72 and the dial plate 4 is effectively utilized. Furthermore, the non-conductive member unlikely affects the characteristics of the image antenna 9*i*. This enables the limited space within the exterior case 2 to be effectively utilized while achieving improvement in the reception sensitivity of the antenna 9.

The radio wave watch 1 may have a planar, non-conductive rotating member opposed to the substrate 7, for example, the date plate and a day plate. In this case, it is preferable for this rotating member to be disposed not to overlap with the emitting electrode 91 and disposed to overlap with the second region 72, in the direction of the center axis line X1 of the exterior case 2. For example, the date plate 13 illustrated in FIG. 18 is disposed in the outermost periphery in the inner space of the exterior case 2. The inner periphery of the date plate 13 is located, at least, outside in the radial direction relative to the emitting electrode 91. Furthermore, a part of the date plate 13 overlaps with the second region 72 of the ground layer 70 when viewed in the axial direction. Such a placement can achieve enlarging the date plate 13 in diameter while reducing the influence on the reception sensitivity of the antenna 9.

The connecting part 93 of the present embodiment connects the emitting electrode 91 with the receiving circuit 15 by capacitive coupling. The connecting part 93 is disposed at a position that is closer to the center of the exterior case 2 than the short-circuit part 92 is. The connecting part 93 is far from the inner wall surface 21*a* of the exterior case 2, so that the capacitive coupling between the connecting part 93 and the emitting electrode 91 is unlike to be affected by the exterior case 2.

Note that, in the present embodiment, the antenna center of the antenna 9 is disposed on the straight line that links the center of the battery 8 to the center axis line X1, but this placement is one example. In the example of the present embodiment, the center of the antenna 9 is disposed at the position of approximately 12 o'clock, and the center of the battery 8 is disposed at the position of approximately 6 o'clock. Instead of this, the center of the antenna 9 may be disposed at a position between 9 o'clock and 11 o'clock, and the center of the battery 8 may be disposed at a position between 4 o'clock and 6 o'clock.

Note that, in the ground layer 70, the shape of the first region 71 may be different from the shape of the second region 72. The length LG1 of the first region 71 may be different from the length LG2 of the second region 72. For example, the length LG1 of the first region 71 may be greater than the length LG2 of the second region 72.

Not only the antenna 9 receives the radio wave, but also it may be used for transmitting the radio wave. For example, the antenna 9 may be used to perform transmission to and reception from peripheral equipment. In this case, the radio wave watch 1 may communicate with other equipment via short-distance wireless communication by, for example, Bluetooth (registered trademark) or Wi-Fi. In the case where the antenna 9 transmits the radio wave, power is supplied to the emitting electrode 91 through the connecting part 93. The radio wave watch 1 may have a radio communication circuit including the receiving circuit 15 and a transmitting circuit. In this case, the connecting part 93 connects the radio communication circuit with the emitting electrode 91.

First Variation of Embodiment

Figure 22:
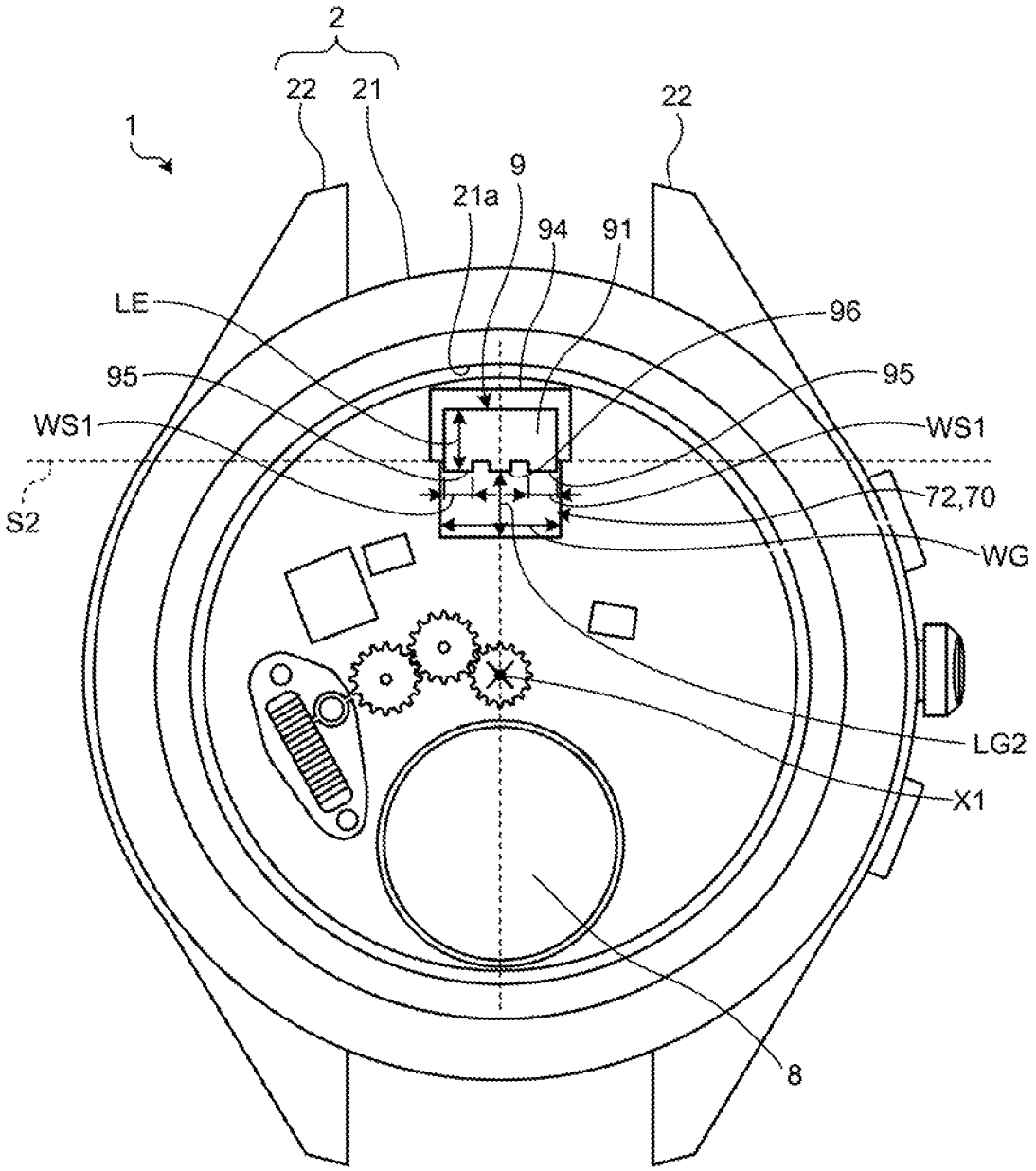
FIG. 22 is a plan view illustrating a radio wave watch according to a first variation of the embodiment.
Figure 23:
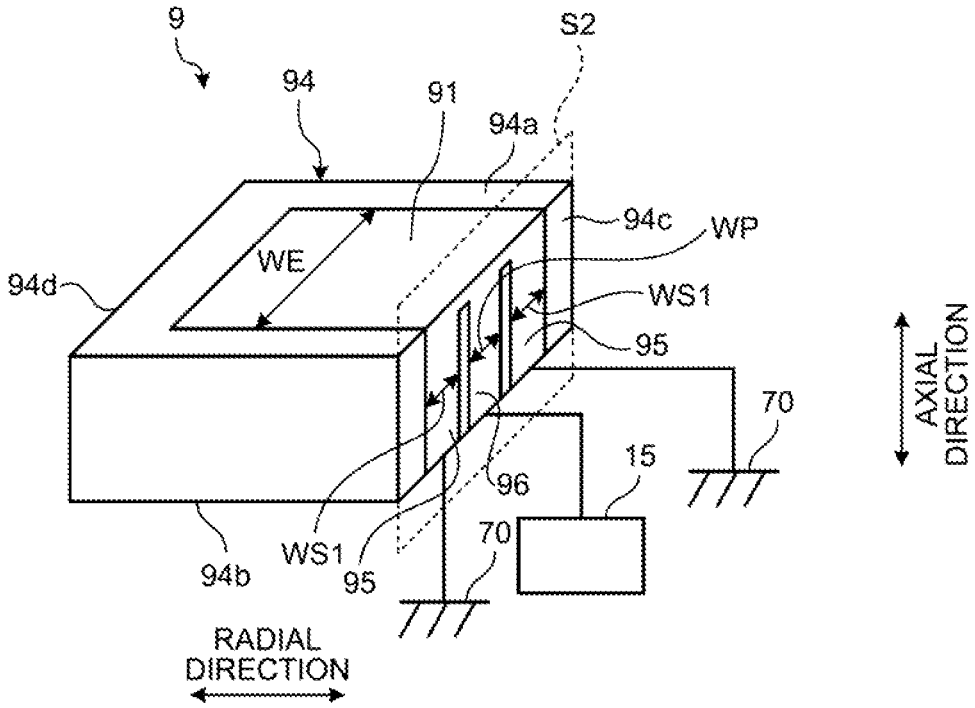
FIG. 23 is a perspective view of an antenna according to the first variation of the embodiment.
Figure 24:
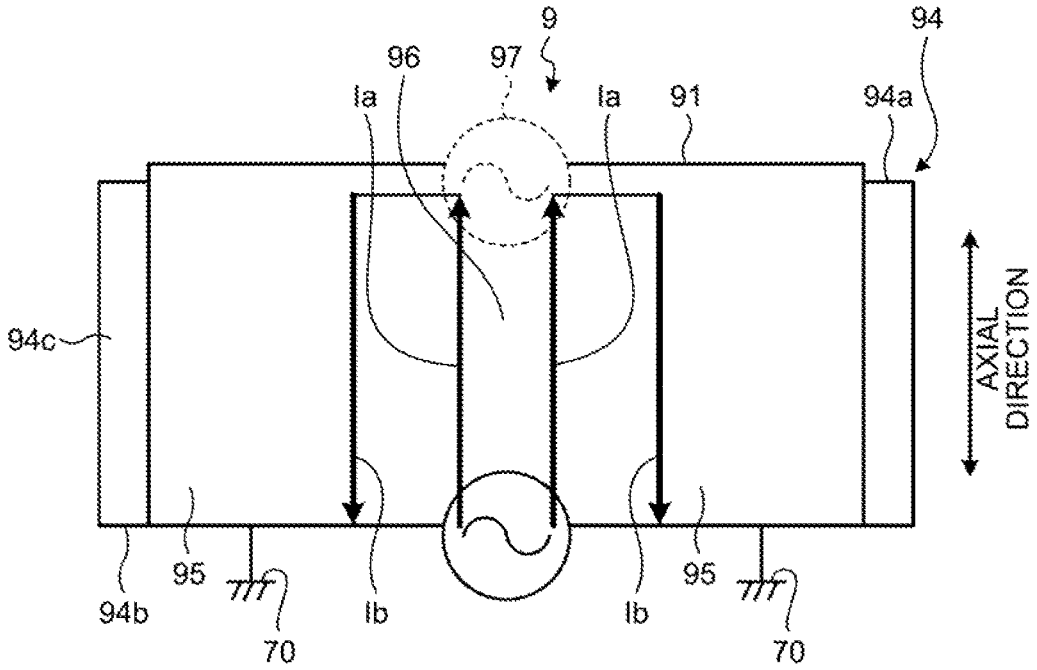
FIG. 24 is a front view of the antenna according to the first variation of the embodiment.
Figure 25:
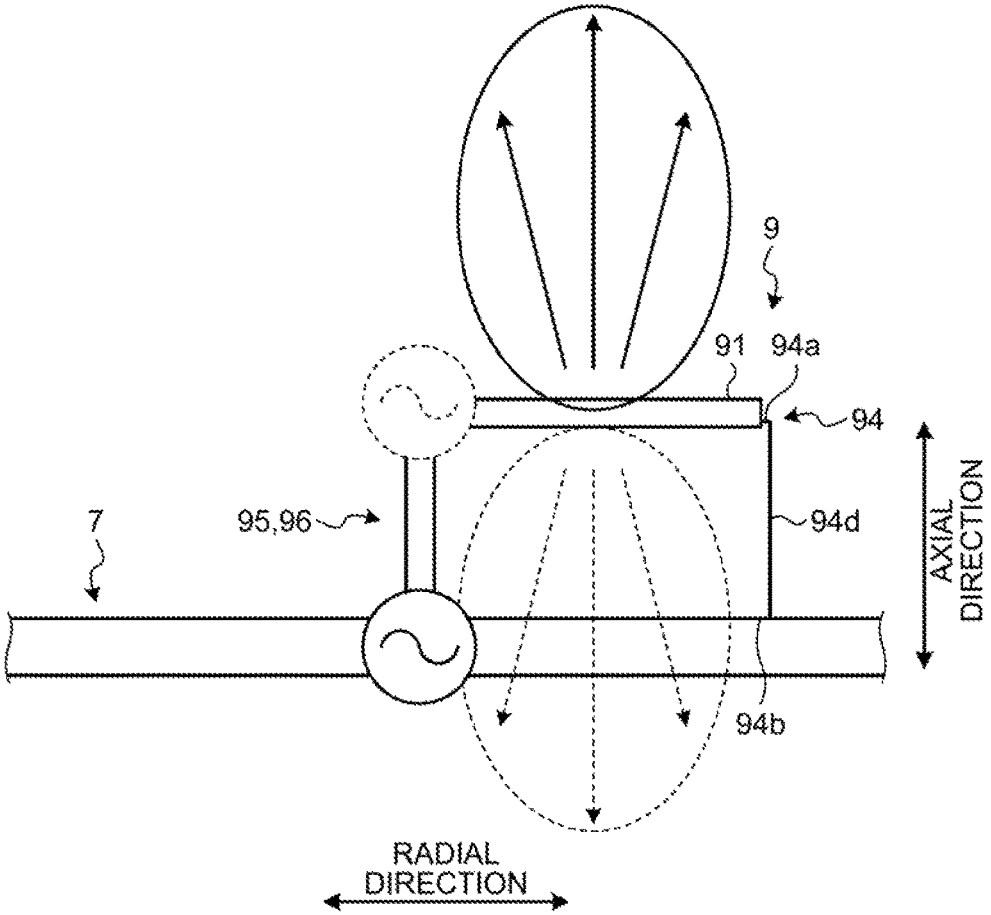
FIG. 25 is a side view describing the directivity of the antenna.

With referring to FIGS. 22 to 27, a first variation of the embodiment will be described. FIG. 22 is a plan view illustrating a radio wave watch according to the first variation of the embodiment; FIG. 23 is a perspective view of an antenna according to the first variation of the embodiment; FIG. 24 is a front view of the antenna according to the first variation of the embodiment; and FIG. 25 is a side view describing the directivity of the antenna. The antenna 9 of the first variation has a connecting part 96 instead of the connecting part 93 of the above embodiment. In the radio wave watch 1 of the first variation, the configuration other than the antenna 9 is similar to that of the above embodiment. The connecting part 96 connects the receiving circuit 15 to the emitting electrode 91 physically and electrically. The connecting part 96 is a planar constituent part and disposed on the first side surface 94*c*. The connecting part 93 of the above embodiment indirectly connects the emitting electrode 91 to the receiving circuit 15 by capacitive coupling. In contrast, the connecting part 96 of the first variation directly connects the emitting electrode 91 to the receiving circuit 15. In the first variation, the first side surface 94*c* faces inside in the radial direction.

The antenna 9 of the first variation has a paired short-circuit parts 95 and 95. Each of the paired short-circuit parts 95 and 95 is a planar constituent part and disposed on the first side surface 94*c*. The paired short-circuit parts 95 and 95 are disposed in line with the connecting part 96 on both sides of the connecting part 96. The paired short-circuit parts 95 and 95 each extend along the axial direction and are disposed apart from each other in the width direction. The connecting part 96 is disposed between the paired short-circuit parts 95 and 95 and extends along in the axial direction. The connecting part 96 and the paired short-circuit parts 95 and 95 extend along a virtual plane S2. The virtual plane S2 is a plane parallel to the center axis line X1 of the exterior case 2. That is, the connecting part 96 and the paired short-circuit parts 95 and 95 extend to be perpendicular to a perpendicular line drawn from the center axis line X1 to the virtual plane S2.

The connecting part 96, and the paired short-circuit parts 95 and 95 are connected mutually at an end part of the emitting electrode 91 side. That is, the connecting part 96, and the paired short-circuit parts 95 and 95 constitute one conductive member.

In the antenna 9 of the first variation, as illustrated in FIG. 24, the direction of a current Ia flowing through the connecting part 96 and the direction of a current Ib flowing through the short-circuit part 95 are opposite to each other. Thus, in the case where power is supplied to the emitting electrode 91, a substantial power-supplying point is a power-supplying part 97 illustrated in FIG. 24. The direction of the current Ia and the direction of the current Ib are opposite to each other and cancelled mutually, so that the connecting part 96 fails to contribute to substantial emission. That is, the connecting part 96 functions as a transmission path that fails to contribute to emission. Thus, as illustrated in FIG. 25, the emitting electrode 91 of the antenna 9 mainly contributes to emission. The antenna 9 has its directivity along the axial direction as illustrated in FIG. 25. That is, the antenna 9 can receive a radio wave traveling along the axial direction with high sensitivity.

As illustrated in FIG. 23, each of the paired short-circuit parts 95 and 95 has a width WS1. The paired short-circuit parts 95 and 95 are formed into the same shape. For example, the width WS1 of the short-circuit part 95 is greater than a width WP of the connecting part 96.

As illustrated in FIG. 22, the antenna 9 is disposed so that the short-circuit part 95 and the connecting part 96 face inside in the radial direction. The emitting electrode 91 extends from the connecting part 96 toward the outside in the radial direction. In other words, the emitting electrode 91 extends from the connecting part 96 toward the inner wall surface 21*a* of the exterior case 2 along the radial direction.

The second region 72 of the ground layer 70 is disposed inside in the radial direction relative to the antenna 9. Also in the first variation, the position of the second region 72 is the opposite position to the emitting electrode 91 side across the short-circuit part 95 on the substrate 7. The width WG of the second region 72 is equal to or greater than the width WS1 of the short-circuit part 95. Similarly to the above embodiment, the ground layer 70 has the first region 71 corresponding to the antenna 9. The shape of the first region 71 may be the same as that of the second region 72. It is preferable for the length LG2 of the second region 72 to be equal to or greater than the length LE of the emitting electrode 91.

In the radio wave watch 1 of the first variation, the inside in the radial direction relative to the antenna 9 is the region of the image antenna 9*i*. The second region 72 of the ground layer 70 enhances the symmetricity between the antenna 9 and the image antenna 9*i*. This improves the reception sensitivity of the antenna 9 also in the radio wave watch 1 of the first variation.

Figure 26:
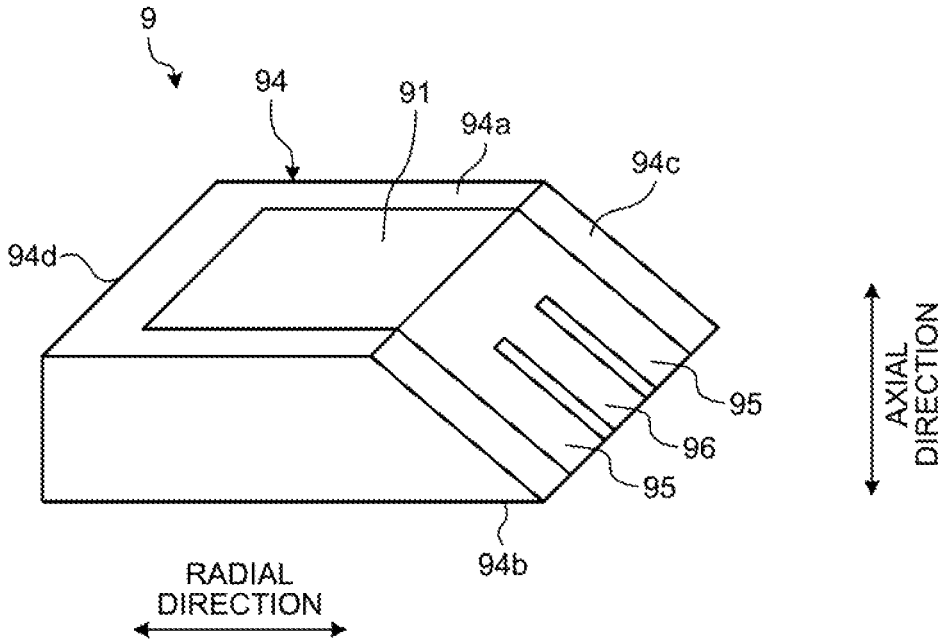
FIG. 26 is a perspective view illustrating one example of the shape of the antenna.

Note that the shape of the antenna 9 may be a shape as illustrated in FIG. 26 in the antenna 9 illustrated in FIG. 26, the first side surface 94*c* of the base part 94 is an inclined face. The first side surface 94*c* is inclined to approach the second side surface 94*d* as it goes from the back surface 94*b* side to the front surface 94*a* side. The short-circuit parts 95 and 95 and the connecting part 96 are inclined similarly to the first side surface 94*c*.

Figure 27:
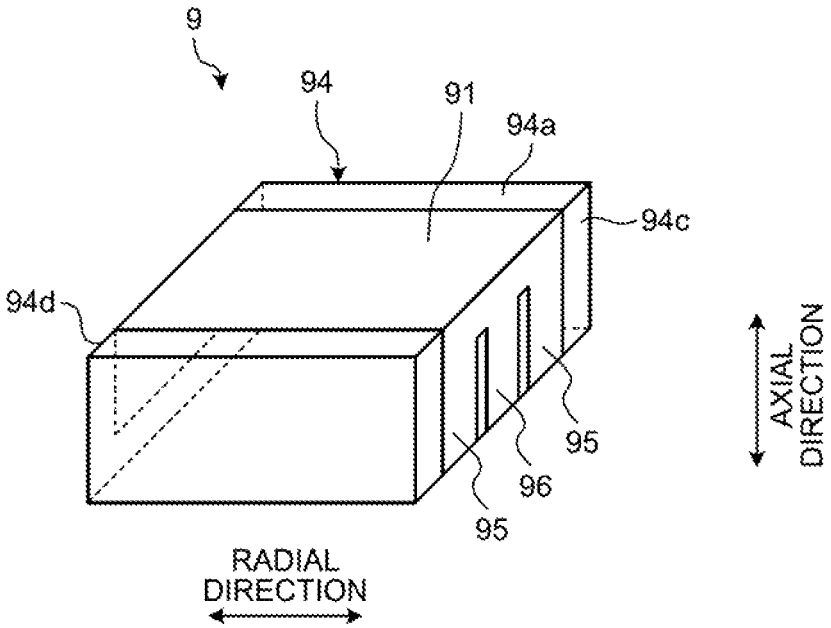
FIG. 27 is a perspective view illustrating another example of the antenna.

The emitting electrode 91 may extend to a surface other than the front surface 94*a* of the base part 94. For example, as illustrated in FIG. 27, the emitting electrode 91 may extend from the front surface 94*a* to the second side surface 94*d*. The extension of the emitting electrode 91 over a plurality of surfaces can achieves downsizing the antenna 9. Various shapes other than the illustrated one can be adopted as the shape of the antenna 9.

In the radio wave watch 1 of the first variation, it is preferable for the metal member to be disposed in the region not overlapping with the emitting electrode 91 in the direction of the center axis line X1. The metal member may be disposed in the region overlapping with the second region 72 of the ground layer 70. The solar cell 6 may have a notch part at the position opposed to the emitting electrode 91 and the second region 72.

The non-conductive member may be disposed to be opposed to the second region 72 of the ground layer 70. In the case where the radio wave watch 1 has a non-conductive rotating member, this rotating member may be disposed not to overlap with the emitting electrode 91 and disposed to overlap with the second region 72, in the direction of the center axis line X1.

Second Variation of Embodiment

Figure 28:
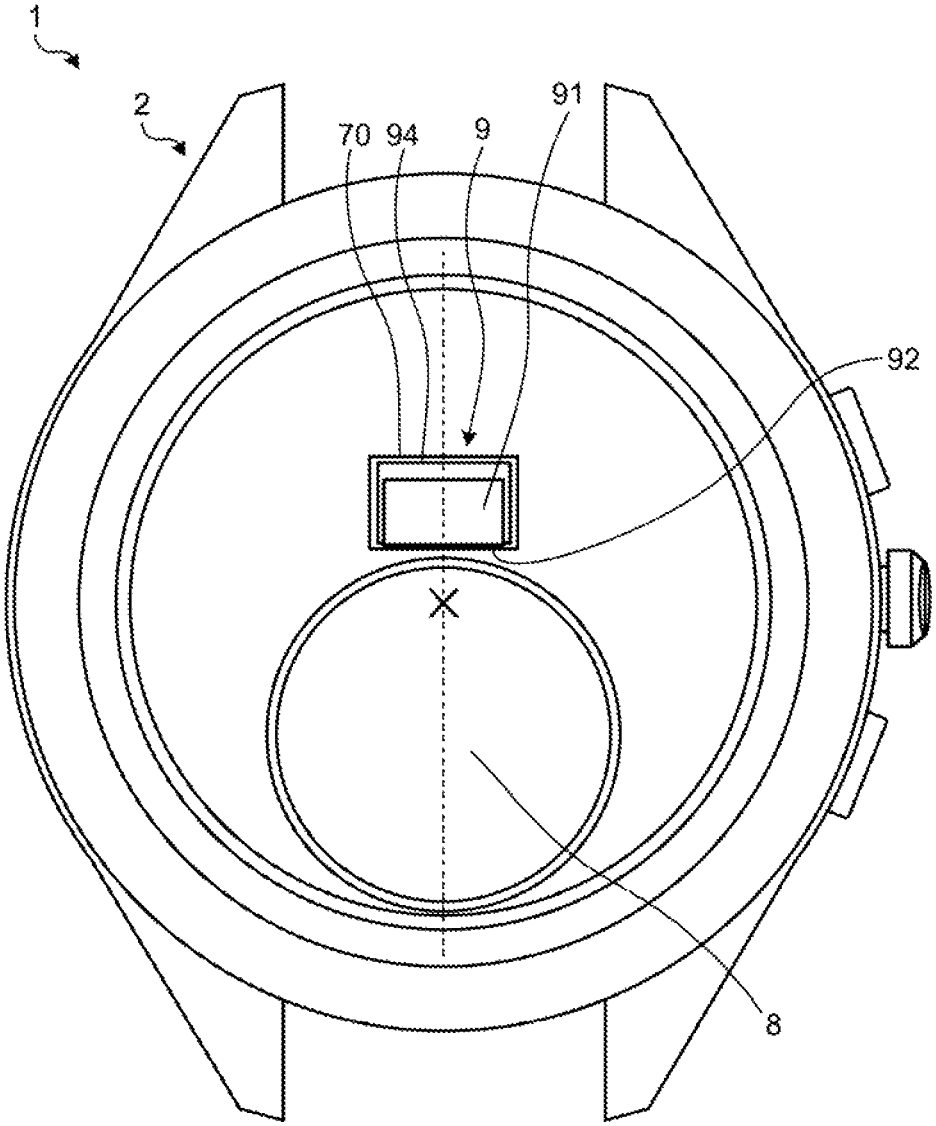
FIG. 28 is a plan view of a radio wave watch according to a second variation of the embodiment.

With referring to FIG. 28, a second variation of the embodiment will be described. FIG. 28 is a plan view of a radio wave watch according to the second variation of the embodiment. In the radio wave watch 1 of the second variation, the battery 8 functions as the second ground layer. The battery 8 is disposed so that its negative electrode faces the front side. The antenna 9 is disposed adjacently to the battery 8 so that the short-circuit part 92 faces the battery 8. The battery 8 is thus located on the opposite side to the emitting electrode 91 across the short-circuit part 92. The negative electrode of the battery 8 functions as the second ground layer and enables the symmetricity between the antenna 9 and the image antenna 9*i* to be improved.

Note that the antenna 9 of the above first variation may be disposed adjacently to the battery 8. In this case, the antenna 9 is disposed adjacently to the battery 8 so that the paired short-circuit parts 95 and 95 face the battery 8. Such a placement is advantageous in the case where it is difficult to secure a region of the substrate 7 for the second region 72. Note that, in the case where the antenna 9 is a direct-connection type, the connecting part 96 of the antenna 9 may be disposed close to the exterior case 2 side, with the exterior case 2 set to the ground potential. In such a placement, the exterior case 2 also functions as the second region 72. For example, such a placement is effective in the case where it is difficult to secure a space on the substrate 7 for the second region 72.

Third Variation of Embodiment

Figure 29:
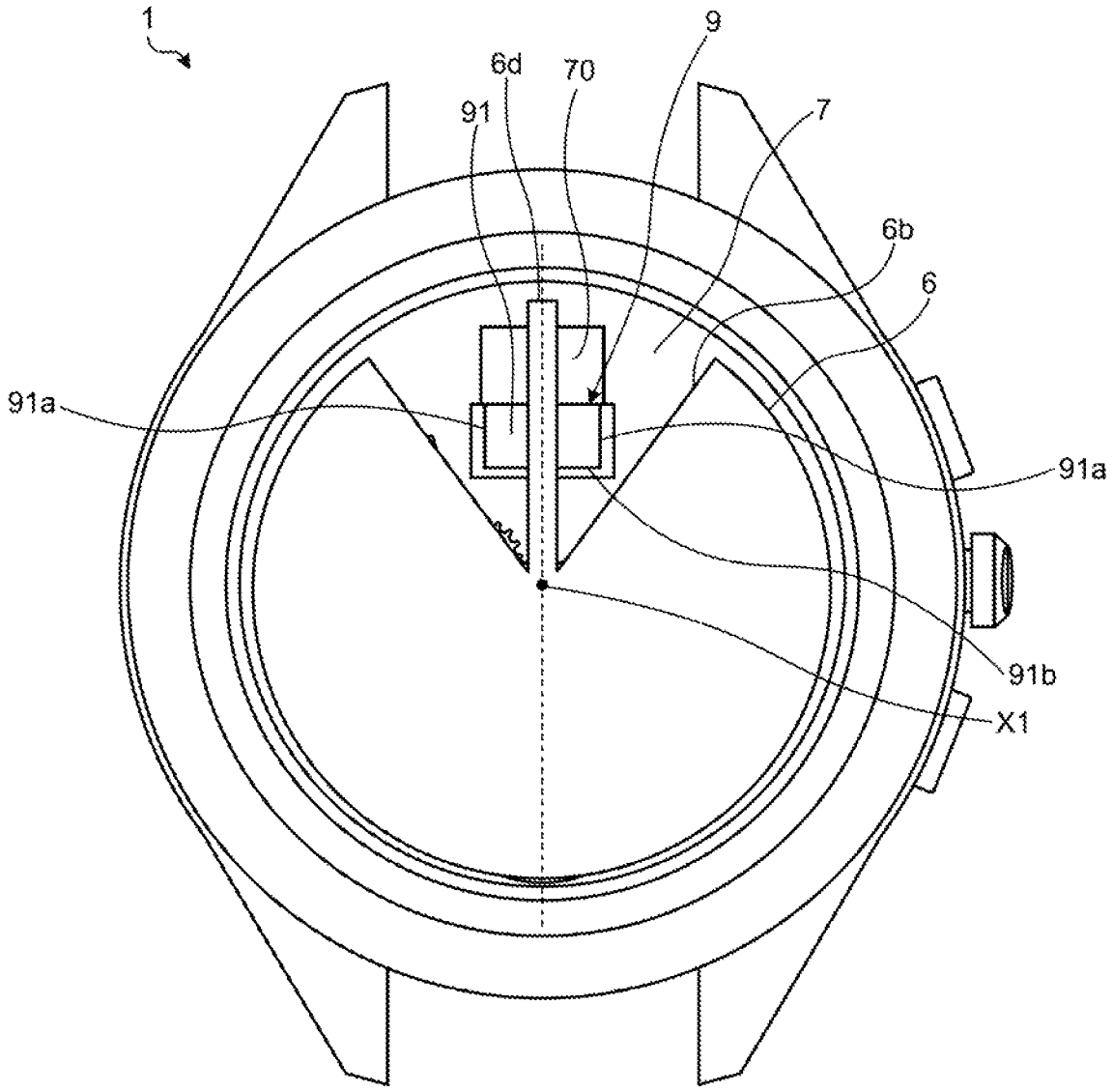
FIG. 29 is a plan view of a radio wave watch according to a third variation of the embodiment.

With referring to FIG. 29, a third variation of the embodiment will be described. FIG. 29 is a plan view of a radio wave watch according to the third variation of the embodiment. The antenna 9 of the third variation is disposed similarly to the antenna 9 of the above embodiment. The solar cell 6 of the third variation has a projecting part 6*d*, which overlaps with the antenna 9 when viewed in the axial-direction.

The solar cell 6 is provided with the notch part 6*b* and has the projecting part 6*d* at the center in the circumferential direction of the notch part 6*b*. The projecting part 6*d* extends from the center axis line X1 toward the outside in the radial direction. The projecting part 6*d* is a rectangular constituent part having a constant width. The projecting part 6*d* is disposed to overlap with a central part in the width direction of the emitting electrode 91 and the ground layer 70. The width of the projecting part 6*d* is less than both the width WE of the emitting electrode 91 and the width WG of the ground layer 70. Thus, the projecting part 6*d* does not overlap with the first emitting sides 91*a* and 91*a* of the emitting electrode 91. The projecting part 6*d* overlaps with the central part of the second emitting side 91*b* when viewed in the axial-direction. The central part of the second emitting side 91*b* is a part where its potential fluctuation is smaller than that in the first emitting side 91*a*. Thus, even when the central part of the second emitting side 91*b* is shielded, this has no large influence on the reception sensitivity of the emitting electrode 91. Thus, the projecting part 6*d* can increase the light-receiving area of the solar cell 6 while reducing the influence on the reception sensitivity of the emitting electrode 91.

Fourth Variation of Embodiment

Figure 30:
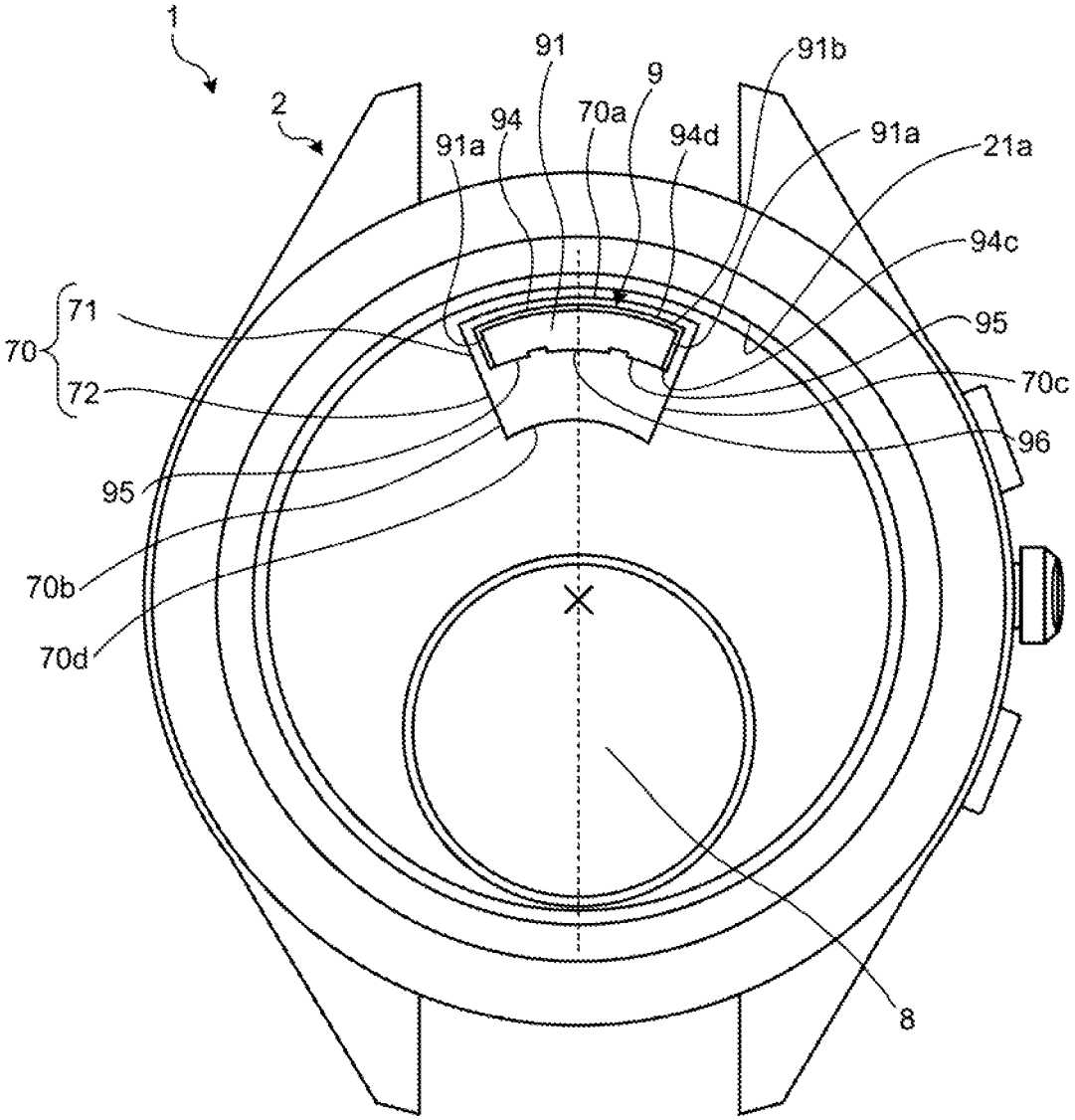
FIG. 30 is a plan view of a radio wave watch according to a fourth variation of the embodiment.

With referring to FIG. 30, a fourth variation of the embodiment will be described. FIG. 30 is a plan view of a radio wave watch according to the fourth variation of the embodiment. The antenna 9 of the fourth variation is curved along the shape of the inner wall surface 21*a* of the exterior case 2.

As illustrated in FIG. 30, each of the first side surface 94*c* and the second side surface 94*d* of the base part 94 is a curved surface having an arc shape. Each shape of the first side surface 94*c* and the second side surface 94*d* is an arc shape concentric with the inner wall surface 21*a* of the exterior case 2. The paired short-circuit parts 95 and 95 and the connecting part 96 are disposed along the first side surface 94*c*. That is, the paired short-circuit parts 95 and 95 and the connecting part 96 extend along a curved surface parallel to the center axis line X1.

The shape of the emitting electrode 91 is a curved shape similar to the base part 94. The shape of the second emitting side 91*b* is an arc shape concentric with the inner wall surface 21*a* of the exterior case 2. The first emitting sides 91*a* are inclined to approach mutually as they go inside in the radial direction.

The shape of the ground layer 70 is a curved shape similar to the base part 94. Each shape of the first side 70*a* and the fourth side 70*d* is an arc shape concentric with the inner wall surface 21*a* of the exterior case 2. The second side 70*b* and the third side 70*c* are inclined to approach mutually as they go inside in the radial direction. It is desirable that the curvature of the curved shape of the ground layer 70 be a curvature where a distance from the center axis line X1 is assumed as a radius. Furthermore, in the case where a rotating member (e.g., a date plate) overlaps with the second region 72 of the ground layer 70, it is preferable to match the curvature of the curved shape of the ground layer 70 with the curvature of the rotating member.

The antenna 9 is disposed in the outside region in the radial direction of the ground layer 70. That is, the outside region in the radial direction of the ground layer 70 is the first region 71, and the inside region in the radial direction is the second region 72.

Note that the first emitting sides 91*a* of the emitting electrode 91 may be parallel to each other. In this case, the second side 70*b* and the third side 70*c* of the ground layer 70 may be parallel. Instead of a direct power-supplying type of the antenna 9, the antenna 9 of the above embodiment, i.e., the antenna 9 where power is supplied to the emitting electrode 91 by capacitive coupling may have a curved shape. In this case, the antenna 9 may be disposed in the inside region in the radial direction of the ground layer 70. It is preferable for the connecting part 93 to be disposed toward the in the radial direction.

Fifth Variation of Embodiment

Figure 31:
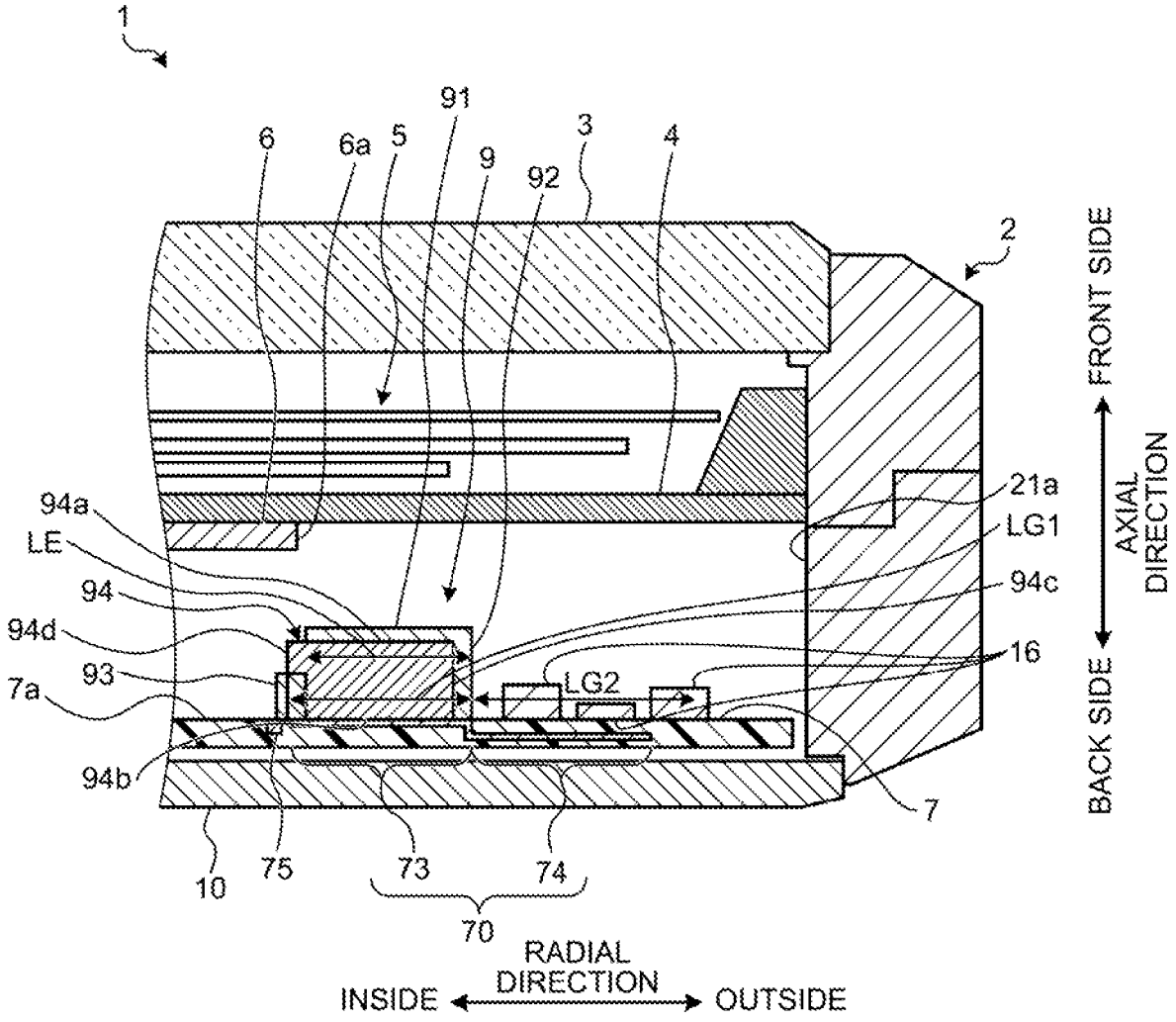
FIG. 31 is a sectional view of a radio wave watch according to a fifth variation of the embodiment.

With referring to FIG. 31, a fifth variation of the embodiment will be described. FIG. 31 is a sectional view of a radio wave watch according to the fifth variation of the embodiment. In the radio wave watch 1 of the fifth variation, a first ground layer 73 and a second ground layer 74 are separated.

The ground layer 70 has the first ground layer 73 and the second ground layer 74. The first ground layer 73 is disposed on the front surface 7*a* of the substrate 7. In contrast, the second ground layer 74 is disposed within the substrate 7. The ground layer 70 is configured so that the potential of the first ground layer 73 is the same as that of the second ground layer 74. For example, the first ground layer 73 and the second ground layer 74 may be electrically connected via a through hole formed in the substrate 7.

The second ground layer 74 is disposed on the opposite side to the first ground layer 73 across the short-circuit part 92. In the fifth variation, the first ground layer 73 is disposed inside in the radial direction relative to the second ground layer 74. In this way, the first ground layer 73 and the second ground layer 74 may be disposed in different layers in the substrate 7. This can contribute to downsizing and thinning because a mounted object 16 having a physical height and the antenna 9 can be disposed on the same plane. Note that the first ground layer 73 and the second ground layer 74 may be disposed independently in the same layer of the substrate 7. The second ground layer 74 may be disposed on the back side (the rear cover 10 side) of the substrate 7.

Sixth Variation of Embodiment

Figure 32:
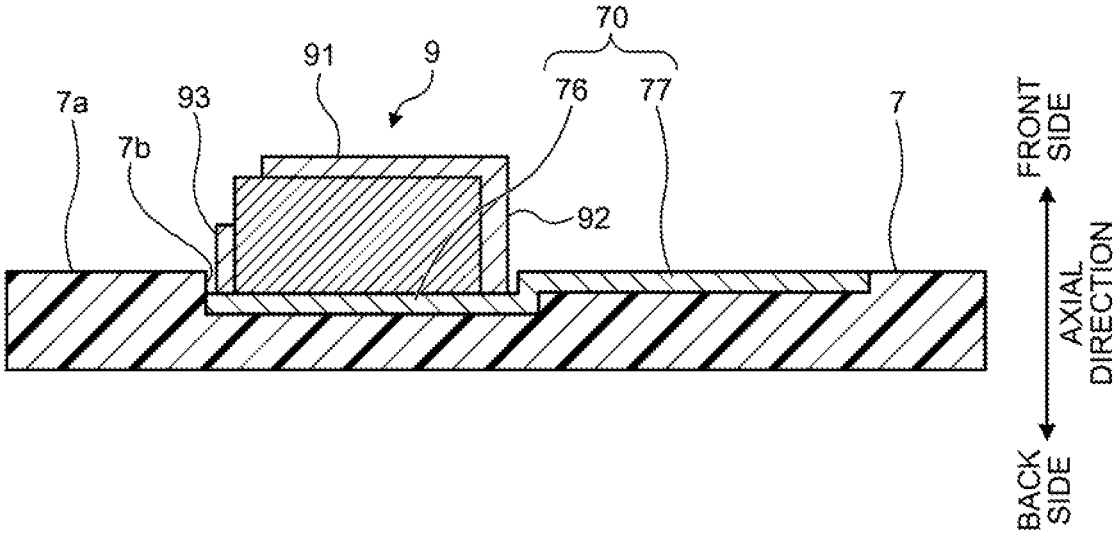
FIG. 32 is a sectional view of a main part of a radio wave watch according to a sixth variation of the embodiment.

A sixth variation of the embodiment will be described. FIG. 32 is a sectional view of a main part of a radio wave watch according to the sixth variation of the embodiment. As illustrated in FIG. 32, the antenna 9 is disposed to be embedded in the substrate 7.

The ground layer 70 according to the sixth variation has a first ground layer 76 and a second ground layer 77. The substrate 7 according to the sixth variation is a stacked substrate. For example, the first ground layer 76 is formed in the bottom layer. Here, the bottom layer is the most back-side layer in a stacked direction of the substrate 7. The substrate 7 has a concave part 7*b* to expose the first ground layer 76. The antenna 9 is accommodated in the concave part 7*b*.

The second ground layer 77 is formed on the front surface 7*a* of the substrate 7. The second ground layer 77 is disposed on the opposite side to the first ground layer 76 across the short-circuit part 92. In other words, the second ground layer 77 is disposed on the opposite side to the emitting electrode 91 across the short-circuit part 92. The first ground layer 76 and the second ground layer 77 are electrically connected. The configuration of this variation contributes to thinning of the watch, for example. Note that the second ground layer 77 may be disposed in a middle layer or the bottom layer of the substrate 7, instead of the front surface 7*a*.

Seventh Variation of Embodiment

Figure 33:
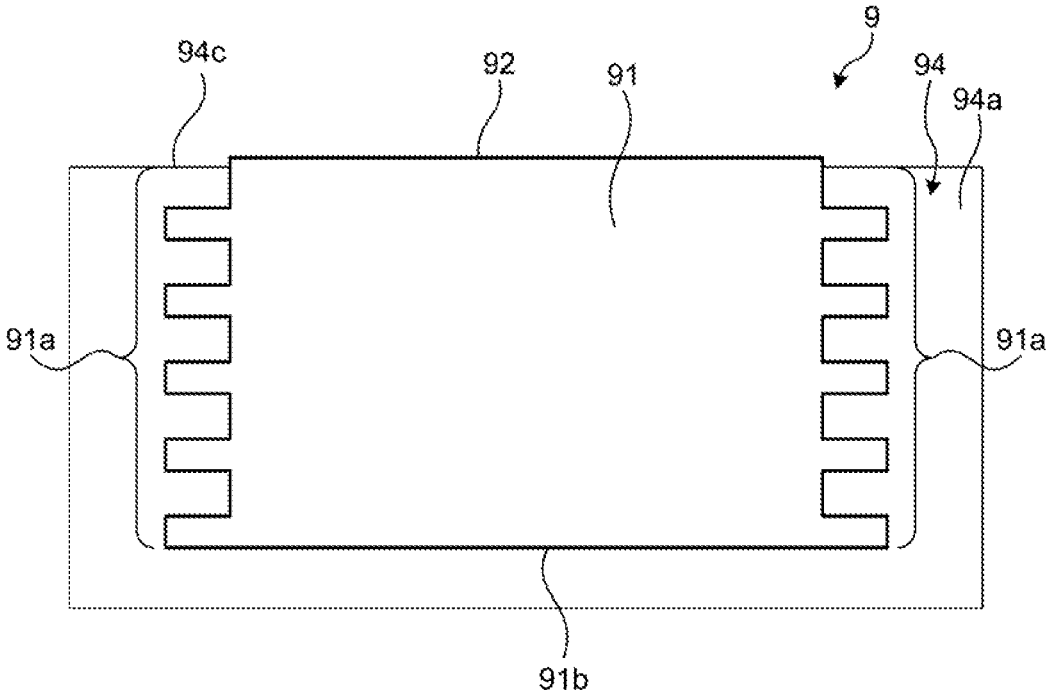
FIG. 33 is a plan view of an antenna according to a seventh variation of the embodiment.

A seventh variation of the embodiment will be described. FIG. 33 is a plan view of an antenna according to the seventh variation of the embodiment. In the emitting electrode 91 according to the seventh variation, the first emitting side 91*a* is formed into a meander shape. The first emitting side 91*a* has continuously formed unevenness. Making the first emitting side 91*a* into the meander shape enables the antenna 9 to be downsized while securing a required antenna length. Note that, in addition to the first emitting side 91*a* or instead of the first emitting side 91*a*, the second emitting side 91*b* may be formed into a meander shape.

Eighth Variation of Embodiment

Figure 34:
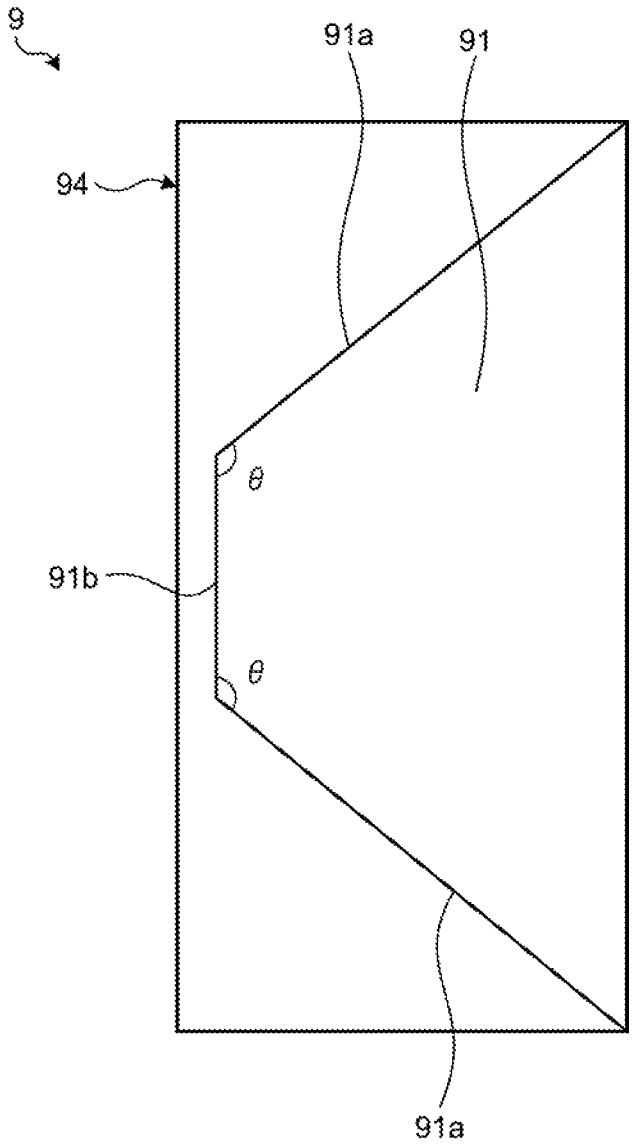
FIG. 34 is a plan view of an antenna according to an eighth variation of the embodiment.
Figure 35:
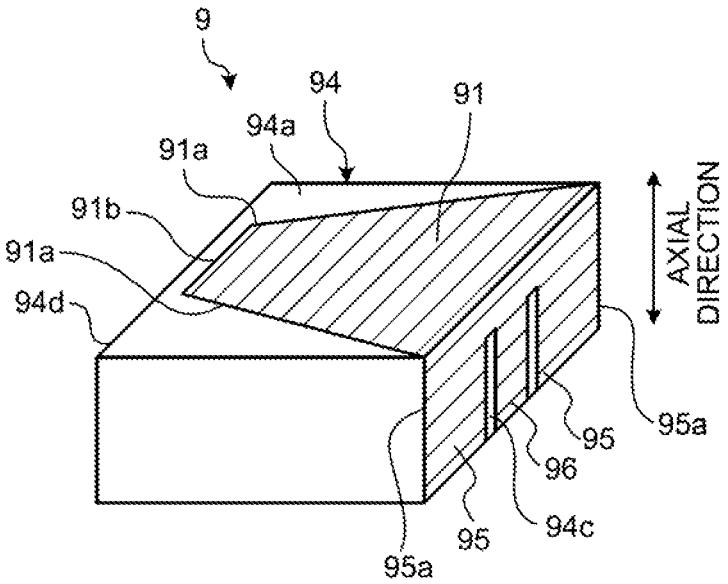
FIG. 35 is a perspective view of the antenna according to the eighth variation of the embodiment.
Figure 36:
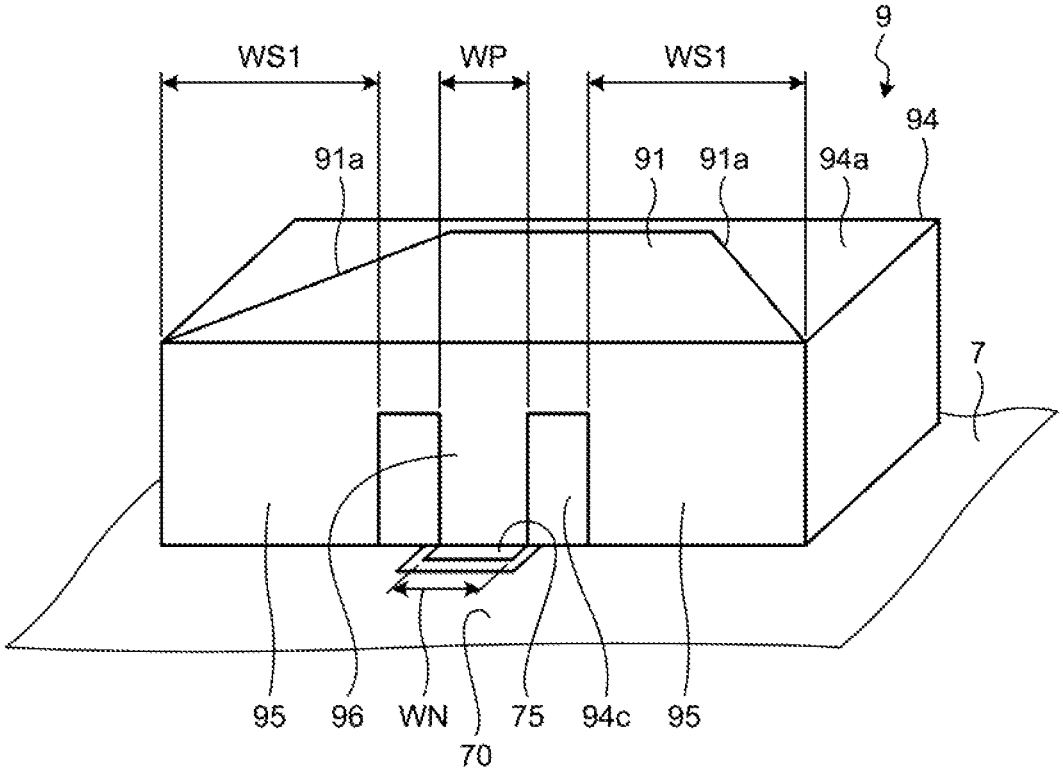
FIG. 36 is a front view of the antenna according to the eighth variation of the embodiment.
Figure 37:
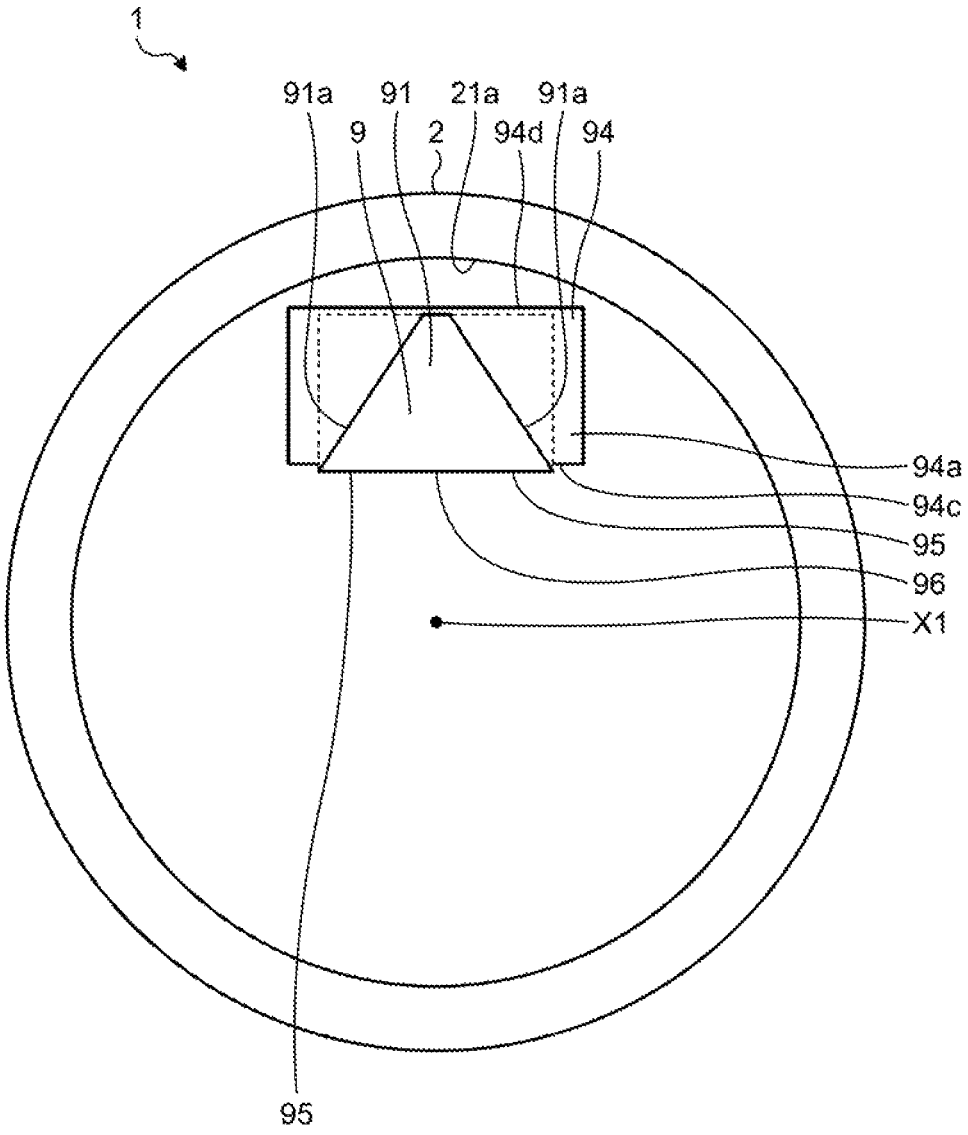
FIG. 37 is a plan view illustrating a placement example of the antenna according to the eighth variation of the embodiment.
Figure 38:
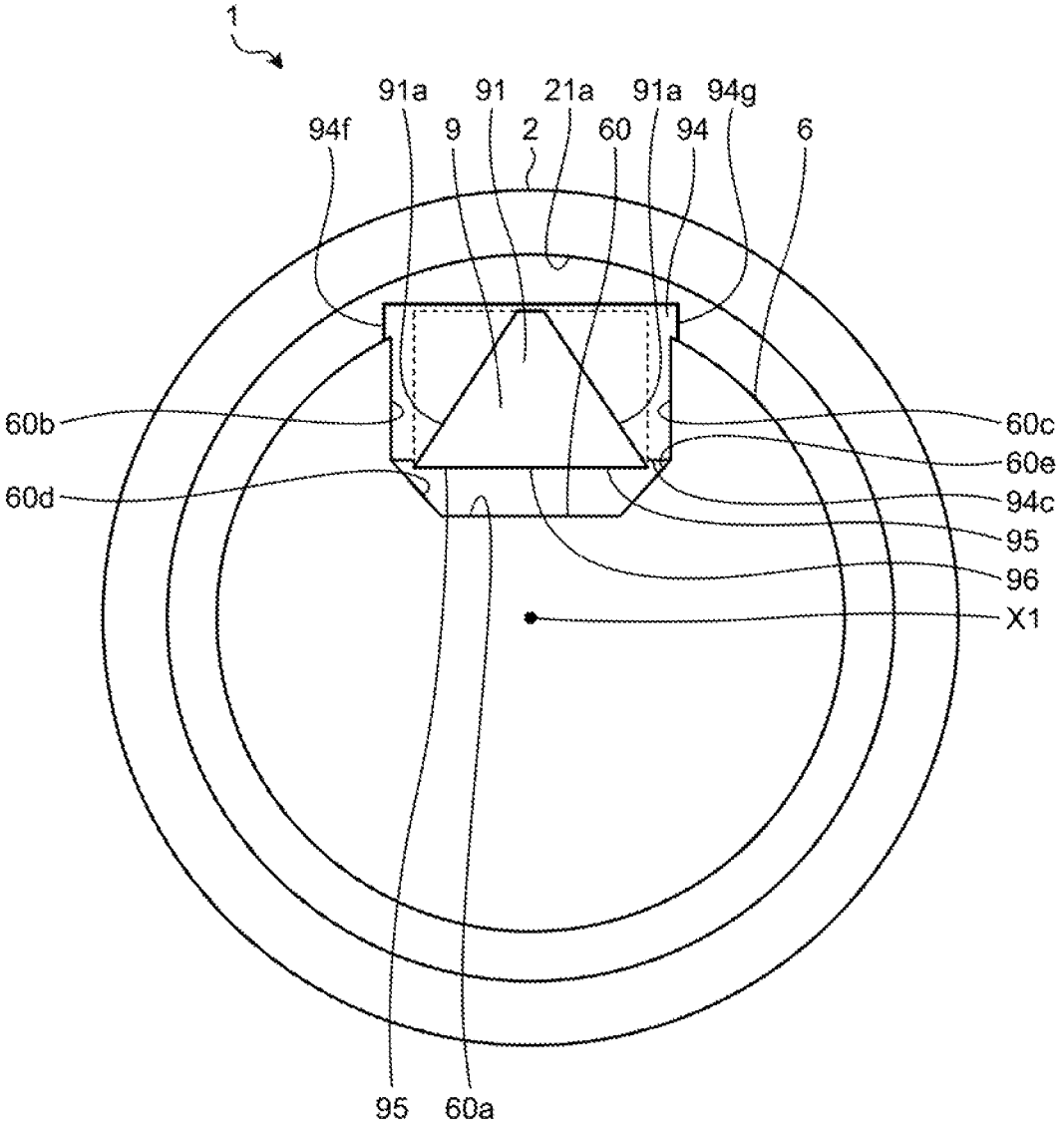
FIG. 38 is a plan view illustrating one example of a shape of the solar cell.
Figure 39:
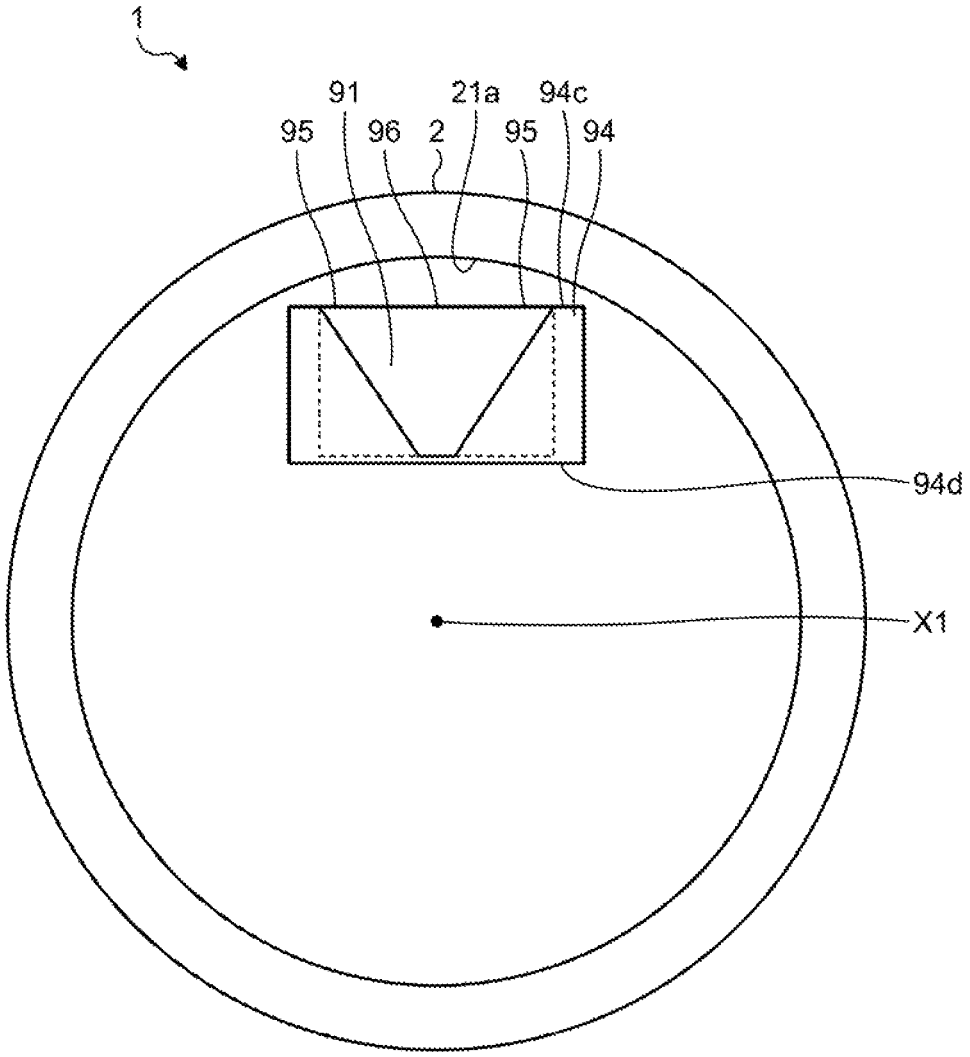
FIG. 39 is a plan view illustrating another placement example of the antenna.

An eighth variation of the embodiment will be described. FIG. 34 is a plan view of an antenna according to the eighth variation of the embodiment; FIG. 35 is a perspective view of the antenna according to the eighth variation of the embodiment; FIG. 36 is a front view of the antenna according to the eighth variation of the embodiment; FIG. 37 is a plan view illustrating a placement example of the antenna according to the eighth variation of the embodiment; FIG. 38 is a plan view illustrating one example of the shape of the solar cell; and FIG. 39 is a plan view illustrating another placement example of the antenna. In the antenna 9 according to the eighth variation, an intersection angle of the second emitting side 91*b* and the first emitting side 91*a* is different from a right angle. More specifically, the first emitting side 91*a* extends so that an intersection angle θ with the second emitting side 91*b* is an obtuse angle. Such an extension of the first emitting side 91*a* in a slanting direction can lengthen the length of the first emitting side 91*a* as compared with the case where the intersection angle θ is the right angle. As a result, the antenna 9 can be downsized while a required antenna length is secured. The shape of the emitting electrode 91 of the eighth variation is a tapering shape in which its width becomes narrower as it goes from the base end to the tip. Here, the base end side of the emitting electrode 91 is a side where the short-circuit part 95 and the connecting part 96 are connected, i.e., the first side surface 94*c* side, and the tip side of the emitting electrode 91 is the second side surface 94*d* side.

To improve the sensitivity of the antenna 9, it is preferable for the area of the emitting electrode 91 to be increased, for example. In this case, it is conceivable that the base part 94 as a foundation is extended. On the other hand, the substantial wavelength λ is shortened by the wavelength-shortening effect as the frame of the base part 91 becomes larger. As a result, the most suitable length of the first emitting side 91*a* is shortened, and the extension of the area of the emitting electrode 91 is limited. The antenna 9 of the eighth variation can maximize the area of the emitting electrode 91 and the length of the first emitting side 91*a* without excessively increasing the frame of the base part 94. Note that the first emitting side 91*a* and the second emitting side 91*b* may be formed into a meander shape. In terms of obtaining stable characteristics of the antenna 9, it is desirable to secure the symmetricity between the inclined, paired first emitting sides 91*a* and 91*a*.

It is preferable for the width WS1 (see FIG. 36) of the short-circuit part 95 to be increased in a feasible range, and it is preferable for the width WP of the connecting part 96 to be decreased in a feasible range. As an example, the width WS1 of the short-circuit part 95 may be greater than the width WP of the connecting part 96. Increasing the width WS1 of the short-circuit part 95 enhances, for example, the effect of the sensitivity improvement by the image antenna 9*i*. Decreasing the width WP of the connecting part 96 can decrease a width. WN of the electrode 75 of the substrate 7. Decreasing the width WN of the electrode 75 reduces capacitive coupling of the electrode 75 with another electrode of a circuit of the substrate 7 and other surrounding metal members. As a result, the impedance matching about the antenna 9 is facilitated.

For example, the antenna 9 of the eighth variation is disposed as illustrated in FIG. 37. The antenna 9 in FIG. 37 is disposed so that the short-circuit part 95 and the connecting part 96 face inside in the radial direction. That is, the connecting part 96 is opposed to the center axis line X1 in the radial direction. The base part 94 may be disposed so that the second side surface 94*d* is close to the inner wall surface 21*a*. The base part 94 is disposed near the inner wall surface 21*a*, so that a space for placing other parts is easily secured in the vicinity of the center axis line X1. Furthermore, a space for the image antenna 9*i* is easily secured inside in the radial direction relative to the antenna 9.

In the case where the shape of the emitting electrode 91 is the tapering shape as in the eighth variation, the solar cell 6 may have a shape as illustrated in FIG. 38. In the radio wave watch 1 in FIG. 38, the solar cell 6 has a notch part 60 at a position opposed to the antenna 9. The notch part 60 is formed not to overlap with at least the emitting electrode 91 in the axial direction. The notch part 60 has a first side 60*a*, second sides 60*b* and 60*c*, and inclined sides 60*d* and 60*e*.

The first side 60*a* is a side parallel to the first side surface 94*c* of the base part 94. The first side 60*a* is located inside in the radial direction relative to the first side surface 94*c*, The second sides 60*b* and 60*c* are sides extending along end surfaces 94*f* and 94*g* of the base part 94. The second sides 60*b* and 60*c* are substantially parallel to the end surfaces 94*f* and 94*g*. The inclined sides 60*d* and 60*e* link the first side 60*a* to the second sides 60*b* and 60*c*, The inclined sides 60*d* and 60*e* extend in a direction inclined relative to the first side 60*a* and the second sides 60*b* and 60*c*. For example, the inclined sides 60*d* and 60*e* extend along the radial direction from the center axis line X1.

In planar view, the second sides 60*b* and 60*c* are opposed to the first emitting side 91*a* of the emitting electrode 91. The second sides 60*b* and 60*c* extend in a direction intersecting with the first emitting side 91*a*. More specifically, in planar view, the second sides 60*b* and 60*c* are separated from the first emitting side 91*a* as they go outside in the radial direction. The second sides 60*b* and 60*c* extend in the direction intersecting with the first emitting side 91*a*, so that currents flowing the second sides 60*b* and 60*c* are unlikely to cause the drop in the sensitivity of the emitting electrode 91. Thus, the solar cell 6 of the eighth variation can achieve maximizing the solar cell 6 while reducing the drop in the sensitivity of the antenna 9.

Note that the antenna 9 may be disposed as illustrated in FIG. 39. The antenna 9 illustrated in FIG. 39 is disposed so that the short-circuit part 95 and the connecting part 96 face outside in the radial direction. That is, the connecting part 96 is opposed to the inner wall surface 21*a* of the exterior case 2 in the radial direction. This placement can increase the distance between the first emitting side 91*a* of the emitting electrode 91 and the inner wall surface 21*a*.

Ninth Variation of Embodiment

Figure 40:
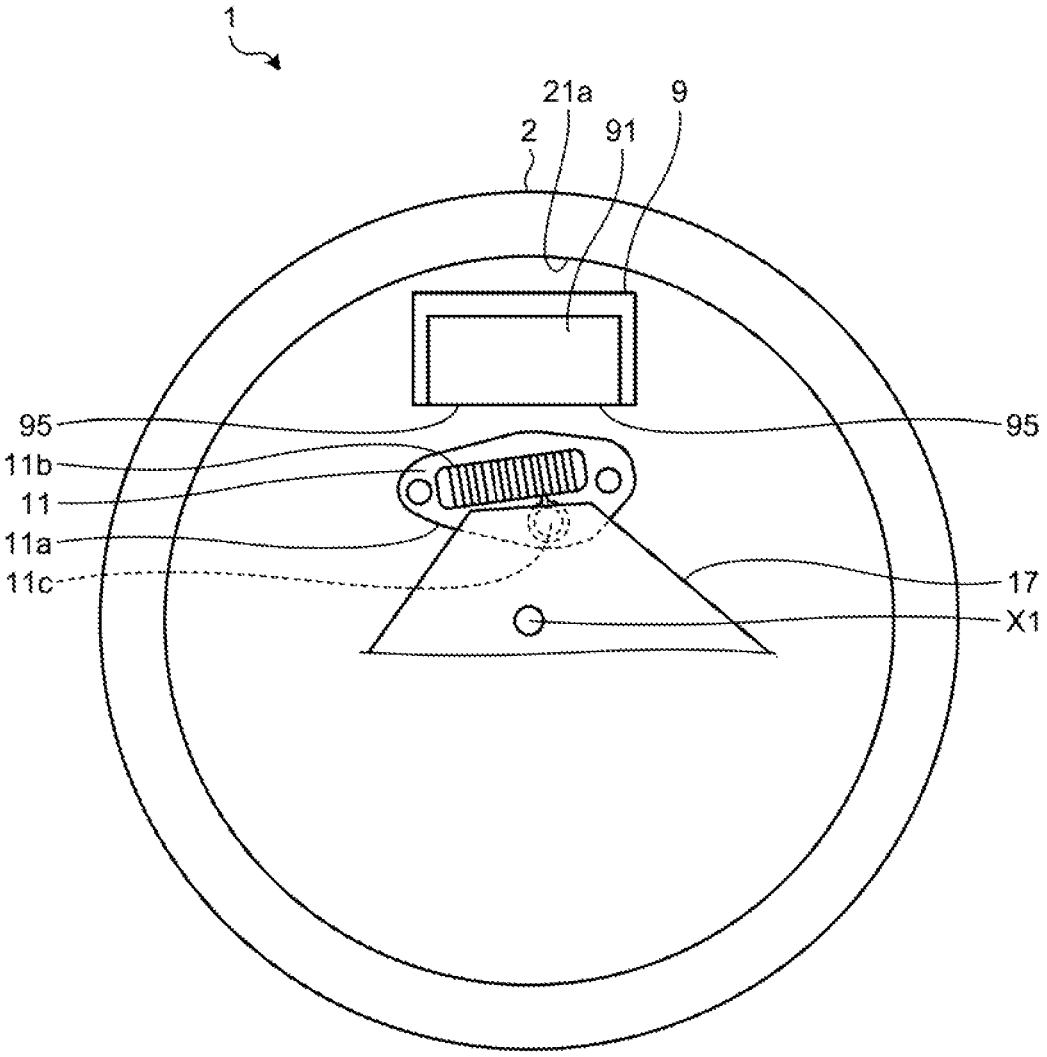
FIG. 40 is a plan view illustrating a placement of a motor according to a ninth variation of the embodiment.

A ninth variation of the embodiment will be described. FIG. 40 is a plan view illustrating a placement of a motor according to the ninth variation of the embodiment. In the radio wave watch 1 according to the ninth variation, a part of a motor 11 is disposed at a position opposed to the short-circuit part 95 in the radial direction. The motor 11 is an electromagnetic motor, and has a housing 11*a*, a coil 11*b*, and a rotor 11*c*. The motor 11 rotates the rotor 11*c* with an induced electromotive force that is generated by powering the coil 11*b*. For example, the motor 11 is installed in the radio wave watch 1 as a drive source rotating the hand. The motor 11 is disposed so that the rotor 11*c* is located on the opposite side to the antenna 9 side relative to the coil 11*b*.

More specifically, the antenna 9 of the ninth variation is disposed so that the short-circuit part 95 faces inside in the radial direction. The motor 11 is disposed inside in the radial direction relative to the antenna 9. The motor 11 is disposed so that the rotor 11*c* is located inside in the radial direction relative to the coil 11*b*. The coil 11*b* thus extends between the rotor 11*c* and the antenna 9. The radio wave watch 1 has a magnetic shield 17. In planar view, the magnetic shield 17 covers the rotor 11*c*. That is, the magnetic shield 17 shields the rotor 11*c* in the axial direction. The magnetic shield 17 of this variation is disposed to cover the rotor 11*c* and not to cover the antenna 9.

As in the ninth variation, the rotor 11*c* of the motor 11 is disposed apart from the antenna 9, so that the magnetic shield 17 can be disposed at a position with few influence on the emitting electrode 91. As a result, the magnetic shield 17 is unlikely to cause the drop in the sensitivity of the antenna 9. Thus, the placement of the ninth variation achieves downsizing by disposing the motor 11 in the vicinity of the antenna 9 while reducing the drop in the sensitivity of the antenna 9 as far as possible.

Tenth Variation of Embodiment

Figure 41:
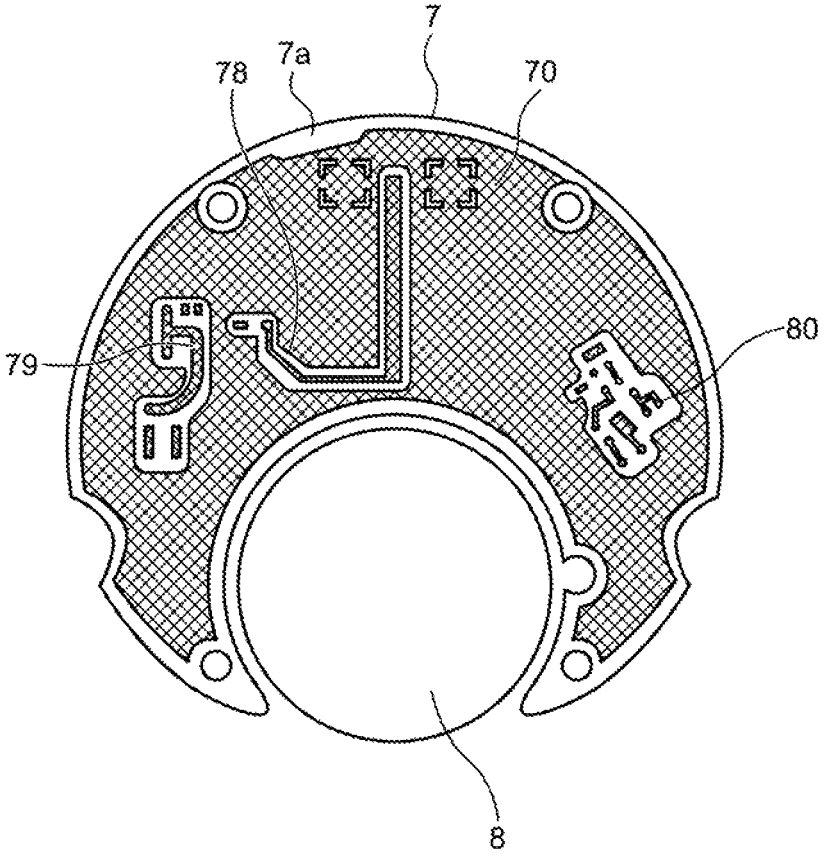
FIG. 41 is a plan view illustrating a placement of a ground layer according to a tenth variation of the embodiment.
Figure 42:
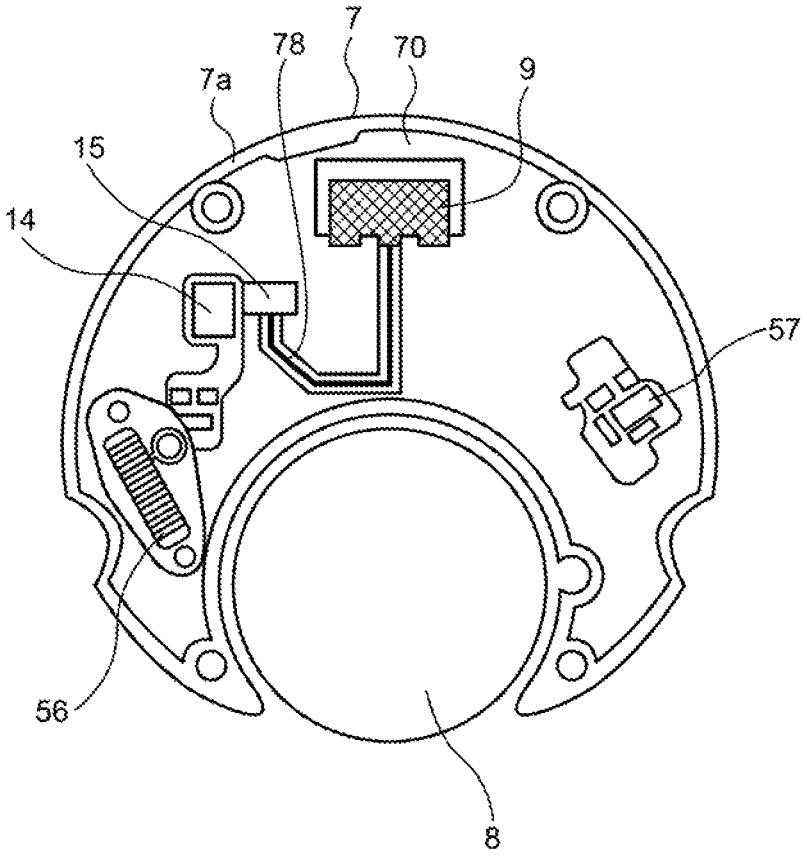
FIG. 42 is a plan view illustrating a condition where a device is disposed on a substrate according to the tenth variation of the embodiment.

A tenth variation of the embodiment will be described. FIG. 41 is a plan view of a ground layer according to the tenth variation of the embodiment, and FIG. 42 is a plan view illustrating a condition where devices are disposed on the substrate according to the tenth variation of the embodiment. The ground layer 70 is only required to be disposed in the region where the image antenna 9*i* is formed, and the shape and placement of the ground layer 70 are not limited to the shape and placement illustrated in the embodiment and other variations. The ground layer 70 according to the tenth variation is formed over the almost whole of the substrate 7 except a region required for wiring.

As illustrated in FIG. 41, the substrate 7 has wirings 78, 79, and 80. The wirings 78, 79, and 80 are conductive films formed on the substrate 7. The wiring 78 connects the connecting part 93 and the connecting part 96 of the antenna 9 to the receiving circuit 15. The wiring 79 connects the control circuit 14 to the drive source 56. Note that, in FIG. 42, the illustration of the wirings 79 and 80 is omitted. The wiring 80 connects between other various circuits 57 (see FIG. 42) disposed on the substrate 7. The various circuits 57 include, for example, an oscillator circuit. The ground layer 70 is formed over the almost whole of the substrate 7 to surround these wirings 78, 79, and 80. The ground layer 70 may be individually disposed on a plurality of layers of the substrate 7. For example, the ground layer 70 is stacked and disposed on the layers including the front surface 7*a* of the substrate 7. Disposing the ground layer 70 having a large area in this way enables the reception sensitivity of the antenna 9 to be further improved.

Eleventh Variation of Embodiment

An eleventh variation of the embodiment will be described. The data included in a radio wave that the radio wave watch 1 transmits and receives is not limited to data including time information for correcting time. The data included in the radio wave to be transmitted and received may be a data signal, such as control program data and measurement data.

The contents disclosed in the embodiment and variations described above can be performed in combination as necessary.

REFERENCE SIGNS LIST

1 radio wave watch
2 exterior case
3 windshield
4 dial plate
5 hand
6 solar cell
6*a* end surface
6*b* notch part
6*c* opening part
6*d* projecting part
7 substrate
7*a* front surface
8 battery
9 antenna
10 rear cover
11 motor
12 cover
13 date plate
14 control circuit
15 receiving circuit
16 mounted object
17 magnetic shield
21 body part
21*a* inner wall surface
22 lug
23 accommodating space
51 second hand.
52 minute hand.
53 hour hand
54 wheel train
55 rotation shaft
56 drive source
60 notch part
70 ground layer
70*a* first side
70*b* second side
70*c* third side
70*d* fourth side
70*p* foot of perpendicular line
70X extension part
71 first region (first ground layer)
72 second region (second ground layer)
73, 76 first ground layer
74, 77 second ground layer
75 electrode
78, 79, 80 wiring
91 emitting electrode
91*a* first emitting side
91*b* second emitting side
92, 95 short-circuit part
93, 96 connecting part
94 base part
94*a* front surface
94*b* back surface
94*c* first side surface
94*d* second side surface
94*e* foot of perpendicular line
LE length of emitting electrode
LG1 length of first region
LG2 length of second region
S1, S2 virtual plane
WG width of ground layer
WE width of emitting electrode
WB width of base part
WP width of connecting part
WS, WS1 width of short-circuit part
X1 center axis line

The invention claimed is:

1. A radio wave watch comprising:
an exterior case;
a dial plate disposed within the exterior case;
a substrate disposed on a rear side of the dial plate within the exterior case;
a first ground layer disposed on the substrate;
an antenna that has a planar emitting electrode disposed between a center of the exterior case and an inner wall surface of the exterior case and opposed to the first ground layer, a planar short-circuit part electrically connecting an end part of the emitting electrode to the first ground layer, and a connecting part connecting the emitting electrode to a receiving circuit of the substrate; and
a second ground layer disposed on an opposite side to the emitting electrode side across the short-circuit part on the substrate and having a width equal to or greater than a width of the short-circuit part.

2. The radio wave watch according to claim 1, wherein
the first ground layer and the second ground layer are integrated with each other.

3. The radio wave watch according to claim 1, wherein
the emitting electrode extends from the short-circuit part toward a radial direction that is a direction perpendicular to a center axis line of the exterior case.

4. The radio wave watch according to claim 1, wherein
the second ground layer extends from the short-circuit part toward the opposite side to the emitting electrode side, and
a length of the second ground layer in an extension direction of the second ground layer is equal to or greater than a length of the emitting electrode.

5. The radio wave watch according to claim 1, wherein
in a space between the dial plate and the substrate, a metal member is disposed in a region not overlapping with the emitting electrode in a direction of a center axis line of the exterior case.

6. The radio wave watch according to claim 5, wherein
the metal member is disposed in a region overlapping with the second ground layer.

7. The radio wave watch according to claim 1, further comprising:
a solar cell disposed between the dial plate and the substrate, wherein
the solar cell has a notch part at a position opposed to the emitting electrode and the second ground layer.

8. The radio wave watch according to claim 1, wherein
in a space between the dial plate and the substrate, a non-conductive member is disposed to be opposed to the second ground layer.

9. The radio wave watch according to claim 1, further comprising:
a plate-shaped, non-conductive rotating member opposed to the substrate, wherein
the rotating member is disposed not to overlap with the emitting electrode and disposed to overlap with the second ground layer, in a direction of a center axis line of the exterior case.

10. The radio wave watch according to claim 1, wherein
the connecting part physically and electrically connects the receiving circuit to the emitting electrode, and
the emitting electrode extends from the connecting part toward the inner wall surface of the exterior case.

11. The radio wave watch according to claim 1, wherein the connecting part physically and electrically connects the receiving circuit to the emitting electrode, and the short-circuit part is disposed in line with the connecting part on both sides of the connecting part and extends along a plane parallel to a center axis line of the exterior case.

12. The radio wave watch according to claim 1, wherein the connecting part connects the emitting electrode to the receiving circuit by capacitive coupling, and the connecting part is disposed at a position that is closer to the center of the exterior case than the short-circuit part is.

* * * * *